US007884689B2

(12) United States Patent
Cetiner et al.

(10) Patent No.: US 7,884,689 B2
(45) Date of Patent: Feb. 8, 2011

(54) MEMS FABRICATION ON A LAMINATED SUBSTRATE

(75) Inventors: Bedri A. Cetiner, Clearfield, KY (US); Mark Bachman, Irvine, CA (US); Guann-Pyng Li, Irvine, CA (US); Jiangyuan Qian, Irvine, CA (US); Hung-Pin Chang, Irvine, CA (US); Franco De Flaviis, Irvine, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 11/428,446

(22) Filed: Jul. 3, 2006

(65) Prior Publication Data

US 2006/0238951 A1 Oct. 26, 2006

Related U.S. Application Data

(63) Continuation of application No. 10/751,131, filed on Dec. 31, 2003, now Pat. No. 7,084,724.

(60) Provisional application No. 60/437,209, filed on Dec. 31, 2002.

(51) Int. Cl.
*H01H 51/22* (2006.01)

(52) U.S. Cl. ..... 335/78; 200/181

(58) Field of Classification Search ..... 335/78; 200/181; 438/51, 64; 216/13
See application file for complete search history.

(56) References Cited

U.S. PATENT DOCUMENTS 6,069,587 A * 5/2000 Lynch et al. ..... 343/700 MS
6,417,807 B1 7/2002 Hsu et al.
6,469,677 B1 10/2002 Schaffner et al.
6,608,268 B1 * 8/2003 Goldsmith ..... 200/181
6,625,004 B1 9/2003 Musolf et al.
6,649,852 B2 * 11/2003 Chason et al. ..... 200/181
6,657,324 B1 * 12/2003 Marumoto ..... 307/125
6,686,820 B1 2/2004 Ma et al.
6,812,814 B2 * 11/2004 Ma et al. ..... 333/262
6,852,926 B2 * 2/2005 Ma et al. ..... 174/539
6,859,119 B2 * 2/2005 Eliacin et al. ..... 200/181
6,924,966 B2 8/2005 Prophet
6,987,435 B2 * 1/2006 Ko et al. ..... 335/78
6,994,757 B2 * 2/2006 Allen et al. ..... 148/430
2003/0015936 A1 1/2003 Yoon et al.
2003/0058069 A1 3/2003 Schwartz et al.

OTHER PUBLICATIONS

Cetiner et al., *Microwave Laminate PCB Compatible RF MEMS Technology for Wireless Communication Systems*, Antennas and Propagation Society International Symposium, 2003. IEEE, Published Jun. 2003, vol. 1, pp. 387-390.

(Continued)

*Primary Examiner*—Anh T Mai
*Assistant Examiner*—Bernard Rojas
(74) *Attorney, Agent, or Firm*—Orrick, Herrington & Sutcliffe, LLP

(57) ABSTRACT

Systems and methods are provided that facilitate the formation of micro-mechanical structures and related systems on a laminated substrate. More particularly, a micro-mechanical device and a three-dimensional multiple frequency antenna are provided for in which the micro-mechanical device and antenna, as well as additional components, can be fabricated together concurrently on the same laminated substrate. The fabrication process includes a low temperature disposition process allowing for deposition of an insulator material at a temperature below the maximum operating temperature of the laminated substrate, as well as a planarization process allowing for the molding and planarizing of a polymer layer to be used as a form for a micro-mechanical device.

14 Claims, 18 Drawing Sheets

OTHER PUBLICATIONS

Cetiner, et al., *Monolithic Integration of RF MEMS Switches with a Diversity Antenna on PCB Substrate*, IEEE Transactions on Microwave Theory and Techniques, vol. 15, No. 1, Jan. 2003, pp. 332-335.

Chang et al., *RF MEMS Switches Fabricated on Microwave-Laminate Printed Circuit Boards*, IEEE Electron Device Letters, vol. 24, No. 4, Apr. 2003, pp. 227-229.

* cited by examiner

MEMS FABRICATION ON A LAMINATED SUBSTRATE

CROSS-REFERENCE TO RELATED APPLICATIONS

This application is a continuation of U.S. patent application Ser. No. 10/751,131, filed Dec. 31, 2003 now U.S. Pat. No. 7,084,724, which claims priority to provisional U.S. patent application Ser. No. 60/437,209, filed Dec. 31, 2002, both of which are fully incorporated by reference herein.

FIELD OF THE INVENTION

The invention relates generally to Micro-Electro-Mechanical Systems (MEMS), and more particularly to the substrate independent fabrication of MEMS structures and related systems on a laminated substrate.

BACKGROUND INFORMATION

A radio frequency (RF) micro-electro-mechanical system (MEMS) provides lower power, higher performance, wider tuning range, and a freedom of integration which traditional RF components cannot. RF MEMS switches are basic building blocks for a variety of RF circuitry. These switches offer better RF performance, lower insertion loss and more isolation than their semiconductor counterparts such as field effect transistors (FETs) and PIN diodes. In addition, RF MEMS switches can operate at low power levels with a high degree of linearity and very low signal distortion. These features make RF MEMS switches very attractive for RF applications such as radar and communications. Indeed, RF MEMS circuits including variable capacitors, tunable filters, on-chip inductors and phase shifters built upon RF MEMS switches have demonstrated superiority over semiconductor devices.

RF MEMS switches can be classified into two types: resistive series and capacitive shunt switches. Both are typically fabricated on expensive semiconductor substrates such as gallium arsenide (GaAs), high-resistivity silicon, quartz or alumina due to the limitations of existing fabrication processes. The switches are then packaged and integrated into RF systems as discrete components since the substrates are generally incompatible with other RF elements. The discrete component packaging costs for RF MEMS switches are much higher than semiconductor switches and therefore, even though the fabrication cost of an individual switch is low due to batch processing, a discretely packaged RF MEMS switch component is expensive compared to the semiconductor switch alternatives.

Furthermore, the lack of a component-to-component compatible substrate typically requires the integration of all RF discrete components and circuits on a system module board. The RF MEMS switch, in addition to the other RF components such as antennas, phase delay lines and tunable filters, are attached and interconnected on the module board. The board-to-package external connections, as well as the switch-to-package connections internal to the RF MEMS switch add undesirable RF, capacitive and inductive effects which degrade system performance. As a result of these connections, the RF system requires additional matching circuits to reduce the unwanted signal reflections occurring as a result of unmatched connections. However, the matching circuits take up additional area and do not solve the matching problems entirely and also add cost and design overhead to the system.

SUMMARY

The present invention is directed to systems and methods that allow fabrication of MEMS structures and related systems directly on a laminated substrate. The present invention is described in this section by way of exemplary embodiments. These embodiments are intended to serve as examples only and are in no way intended to limit the present invention. In one exemplary embodiment, an electrical apparatus is provided including a printed circuit board (PCB) substrate having a maximum operating temperature less than 250 degrees Celsius and a micro-electro-mechanical (MEM) device formed on the PCB substrate.

In another exemplary embodiment, a micro-mechanical device includes a first member composed of a conductive material and formed on a laminated substrate, an actuatable member also composed of a conductive material, and having a first end and a second end, wherein the first end is coupled with the first conductive member and the second end is suspended above a second member and configured to move in relation to the second member and the second member being formed on the substrate and configured to induce movement of the actuatable member. Movement of the actuatable member can be induced by electrostatic, electro-magnetic or thermal forces. The second member can be covered with an insulator material so that movement of the actuatable member can result in capacitive coupling between the actuatable member and the second member.

In another exemplary embodiment, a method for fabricating the micro-mechanical device directly on a laminated substrate is provided. In one embodiment, this method includes forming a first conductive member on the laminated substrate, increasing the energy of a plasma by inductively coupling radio frequency energy into the plasma to create a higher energy plasma and depositing an insulator layer on the first conductive member with a plasma enhanced chemical vapor deposition process using the higher energy plasma at a temperature below the maximum operating temperature of the substrate.

In another exemplary embodiment, a process for molding a polymer layer is provided. This process includes depositing a polymer layer over the substrate and molding the polymer layer with a mold. In one embodiment, the spacers are distributed onto the substrate, the temperature of the polymer is elevated and pressure is applied to the mold to planarize the surface of the polymer. The polymer is cooled and the mold is removed, leaving a planarized surface which can serve as a form on which the actuatable member can be constructed.

In yet another exemplary embodiment, a three-dimensional multiple frequency antenna is provided for. This antenna includes a first conductive layer formed in a semi-circular pattern horizontally on a first side of a substrate, a second conductive layer formed horizontally on a second side of the substrate, including a horizontal wall portion having a first length, a horizontal slot portion having a second length greater than the first length, wherein the second length corresponds to a first resonant frequency, a first vertical wall portion having a third length, a second vertical wall portion having a fourth length, wherein the first and second vertical walls are coupled with the first and second layers and a vertical slot portion having a fifth length greater than the sum of the third and fourth lengths, wherein the fifth length corresponds to a second resonant frequency. In yet another exemplary embodiment, the antenna can be electrically coupled with a coplanar waveguide and a micro-mechanical device that can be used to alter the electrical properties of either the coplanar waveguide, the antenna or both. In another exemplary embodiment, the antenna and the micro-mechanical device as well as additional components can be integrated and fabricated together on the same laminated substrate.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The details of the invention, including fabrication, structure and operation, may be gleaned in part by study of the accompanying figures, in which like reference numerals refer to like parts. The components in the figures are not necessarily to scale, emphasis instead being placed upon illustrating the principles of the invention. Moreover, all illustrations are intended to convey concepts, where relative sizes, shapes and other detailed attributes may be illustrated schematically rather than literally or precisely.

DETAILED DESCRIPTION

The systems and methods described herein provide for the fabrication of micro-electro-mechanical system (MEMS) components and, as described below, other related system components, on a substrate using a low temperature deposition process. More specifically, the MEMS component can be fabricated on a substrate, such as a printed circuit board (PCB), which would normally be damaged from the high temperatures accompanying typical deposition processes.

This is because the deposition process of the present invention takes place at a temperature below the maximum temperature of the substrate. As a result, a MEMS component does not require discrete packaging prior to placement on the substrate. This simplifies the overall fabrication and design processes of a system formed on a low temperature substrate that includes one or more MEMS components and other related system components.

The systems and methods described herein apply to all types of MEMS systems including radio frequency (RF) MEMS systems. In accordance with the present invention, many MEMS components can be fabricated and integrated together on a single substrate without burdensome discrete packaging, simplifying the overall system design and enhancing the system performance. The elimination of discrete packaging allows for increased component density and also eliminates the added impedance derived from the discrete package and its various interconnects. The direct integration of MEMS components onto the board also eliminates the need for additional matching circuits. Furthermore, a MEMS component can be integrated with other devices fabricated directly on the substrate, such as an antenna, again resulting in enhanced system performance.

In order to facilitate the following discussion, the systems and methods described herein will be discussed in the context of an RF application. It is understood, however, that these systems and methods can be used in conjunction with any application where a MEMS component, or any other component that requires an insulation layer is placed directly on a low temperature substrate. These other components include, but are not limited to tunable filters and inductors, tunable RF matching circuits, variable capacitors, inductors and the like. Furthermore, the MEMS component does not necessarily require electrical functionality and could be described as a micro-mechanical component as well. However, to facilitate discussion, the various micro-mechanical components will be described as MEMS components with the intention that this does not limit these components to any one type of functionality.

Figure 1A:
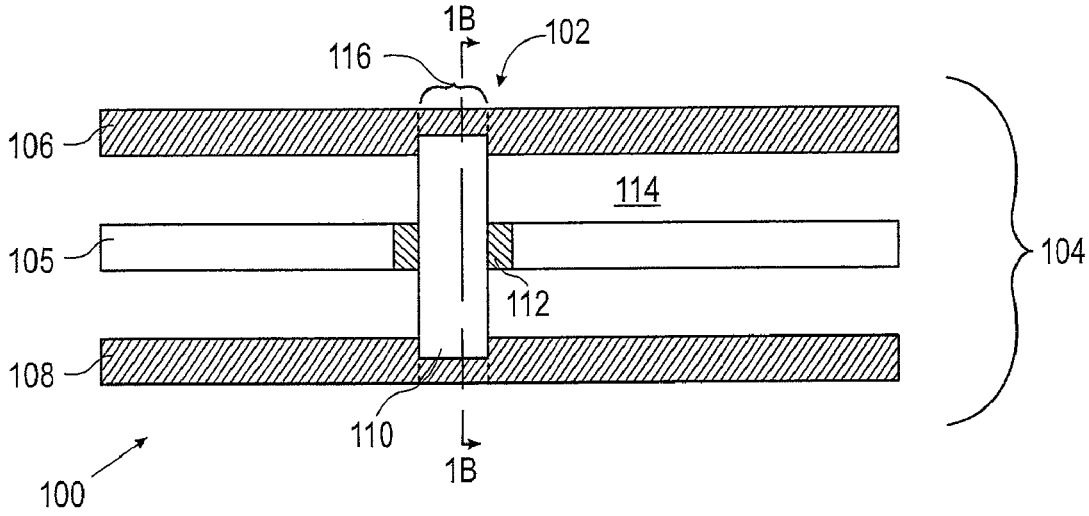
FIG. 1A depicts a top view of one exemplary embodiment of an RF MEMS system fabricated in accordance with the low temperature deposition process of the present invention.
Figure 1B:
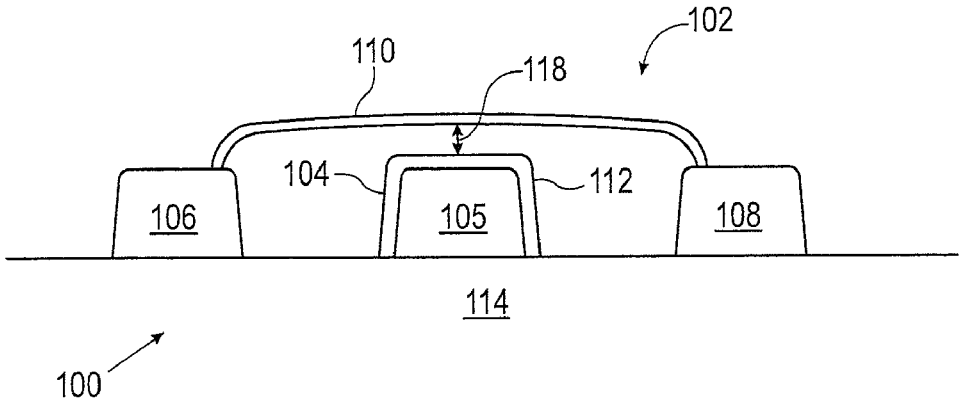
FIG. 1B depicts a side sectional view of the RF MEMS system shown in FIG. 1A and taken along line 1B-1B of FIG. 1A.

Referring in detail to the figures, FIG. 1A depicts a top view of one exemplary embodiment of an RF MEMS system 100 fabricated using the low temperature deposition process of the present invention. The RF MEMS system 100 preferably includes an RF MEMS component 102, which can be a capacitive shunt switch fabricated on a low temperature substrate 114 such as a PCB substrate or the like. FIG. 1B depicts a side sectional view of the switch 102 taken along line 1B-1B of FIG. 1A. In this embodiment, the switch 102 includes a transmission line 104 having three conductive members 105, 106 and 108. Transmission line 104 is commonly referred to as a coplanar waveguide (CPW). A conductive RF signal line 105 is located on the substrate 114 and includes an insulator layer 112, which substantially covers the a portion of the conductive signal line 105. The two ground planes 106 and 108 are located on opposite sides of the signal line 105. An actuatable member 110 is conductively coupled to the ground planes 106 and 108 and extends over and is suspended above the signal line 105 in spaced relation thereto. The signal line 105 and ground planes 106 and 108 are fabricated at substantially the same height and the signal line 105 and ground planes 106 and 108, as well as the actuatable member 110 are all composed of a conductive material, such as aluminum or copper and the like.

In a preferred embodiment, the ground planes 106 and 108 are electrically coupled together and placed at a single electrical potential, preferably ground. The RF signal line 105 is electrically isolated from the ground planes 106 and 108 and is preferably placed at a separate electrical potential, either static or time-varying. When the difference in potential between the signal line 105 and the ground planes 106 and 108 becomes sufficiently great, the switch 102 switches, or closes. More specifically, when the switch 102 switches to the closed down state, the actuatable member 110 physically moves towards the signal line 105 across a gap 118 and physically contacts the insulator layer 112. This capacitively couples the actuatable member 110 with the signal line 105.

The insulator layer 112 insulates the signal line 105 and blocks any direct current (DC) from flowing between the signal line 105 and the actuatable member 110 when they are in proximity with each other or physically coupled together. The nature of the capacitive coupling allows time-varying current to pass between the signal line 105 and the actuatable member 110, which alters the electrical characteristics of the transmission line 104, such as the resonant frequency. The insulator layer 112 preferably covers the signal line 105 sufficiently so that the DC remains blocked. As depicted in FIG. 1A, the insulator layer 112 is preferably deposited over a length of the signal line 104 that is greater than the width 116 of the actuatable member 110 in order to protect the switch 102 from any variances in the placement of the actuatable member 110, either during fabrication or during switching, which could result in DC flow.

The difference in potential that is sufficient to capacitively couple the signal line 105 with the actuatable member 110 is referred to as the switch potential or actuation potential. The switch potential can be varied depending on the needs of the application. The switch potential can be directly related to the rigidity of the actuatable member 110, the size of the gap 118 or the distance between the member 110 and the signal line 105. In general, the switch potential increases as both the rigidity of the actuatable member 110 increases or the gap 118 between the actuatable member 110 and the signal line 105 increases. The rigidity of the actuatable member 110 can be varied by using more or less rigid materials in fabrication, or by otherwise altering the surface, structure or dimensions of the actuatable member 110. The switch 102 allows a higher switch potential (on the order of 20V and greater) than typical switches because the elevated structure of the actuatable member 110 is a physically more rigid design.

In another embodiment, the signal line 105 is formed at a lower height than the two ground planes 106 and 108, and the actuatable member 110 lies suspended between the two ground planes 106 and 108 and is at substantially the same height as the two ground planes 106 and 108. In a more simple embodiment, only one ground plane 106 is present in the substrate plane and one end of the actuatable member 110 is electrically coupled to that ground plane 106, while the other end extends over and is left suspended above the signal line 105. Another ground plane can be placed in a separate substrate plane if desired. These embodiments generally provide a less rigid actuatable member 110.

In this embodiment, the switch 102 operates by way of the electrostatic forces generated between the actuatable member 110 and the signal line 105. Signal line 105 induces movement of the actuatable member 110 through electrostatic attraction, which pulls the actuatable member 110 into proximity with the signal line 105 to close the switch 102. Conversely, the switch 102 is opened either by generating an electrostatic repulsion between the member 110 and the line 105, or by reducing the electrostatic attraction to such a degree where the physical rigidity of the actuatable member 110 operates to recoil the actuatable member 110 to an open position. The switch 102 is not limited to electrostatic operation however. The switch 102 can also implement electromagnetic forces to induce movement of the actuatable member 110, where the closed switch 102 alters the magnetic coupling between the actuatable member 110 and another member.

In another embodiment, movement of the actuatable member 110 is induced by thermal effects, such as through the relative change in thermal expansion between two or more members. For instance, the actuatable member 110 can be made to move by thermal expansion resulting from the heating of the actuatable member 110. Alternatively, a member in proximity with the actuatable member 110 can physically move the actuatable member 110 by thermally expanding and retracting as a result of the amount of heat applied to that member.

Figure 2:
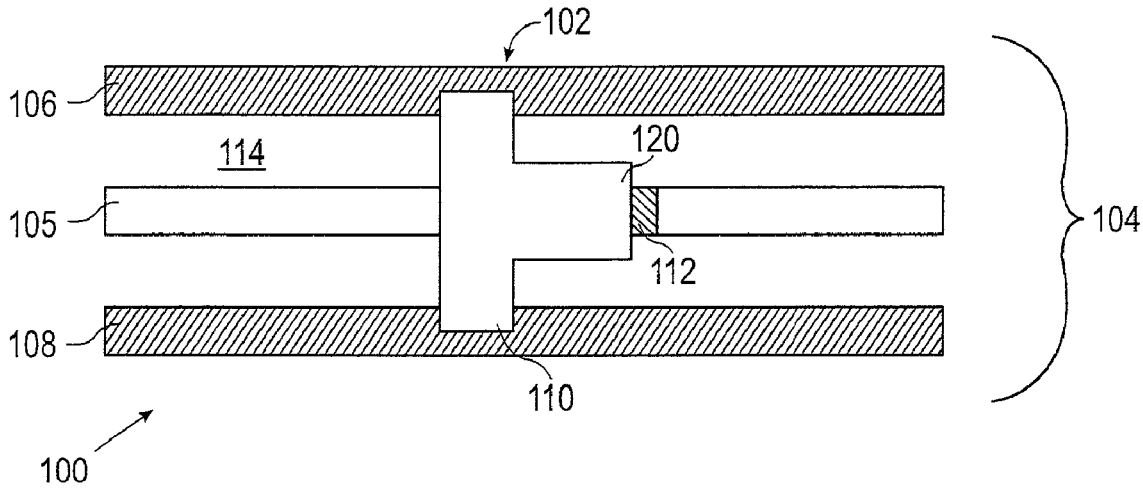
FIG. 2 depicts a top view of another embodiment of an RF MEMS system fabricated in accordance with the low temperature deposition process of the present invention.

FIG. 2 depicts a top view of another embodiment of a switch 102 fabricated using the low temperature deposition process of the present invention. In this embodiment, the member 110 is preferably T-shaped with an outcropping 120 that extends longitudinally along the signal line 105. This embodiment can be implemented in an application that requires a lower switch potential because, due to cantilever effects, the structural resistance to displacement by the actuatable member 110 is decreased by the addition of the outcropping 120. Also, the amount of surface area of the actuatable member 110 which is in proximity with the signal line 105 is increased, and therefore the switch potential needed to attract the actuatable member 110 is decreased. In this embodiment, the outcropping 120 will capacitively couple with the signal line 105 before the remainder of the actuatable member 110, thus allowing capacitive coupling to occur even when only the outcropping 120 is in physical contact with the signal line 105. This embodiment tends to illustrate how varying the structure of the actuatable member 110 can vary the switch potential. However, one of ordinary skill in the art will readily recognize that there are numerous methods in addition to this for varying the switch potential.

Figure 3B:
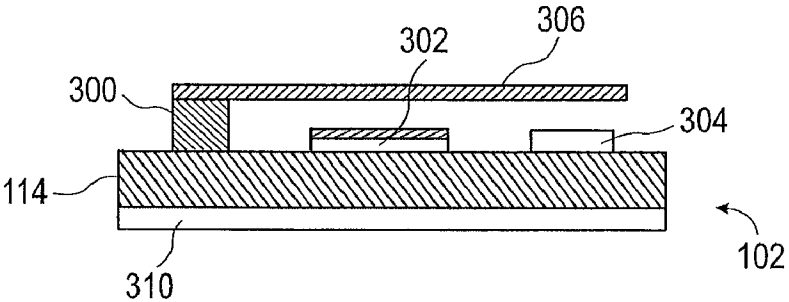
FIG. 3B depicts a side sectional view of the RF MEMS system shown in FIG. 3A and taken along line 3B-3B of FIG. 3A.
Figure 3C:
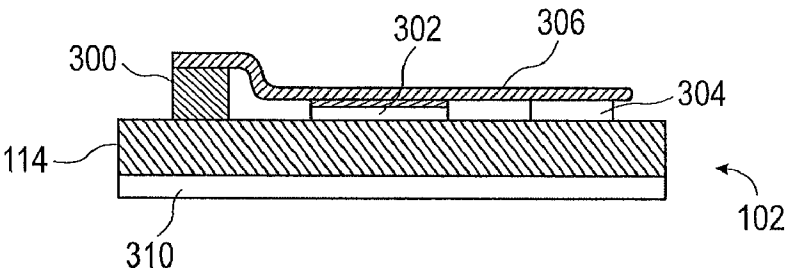
FIG. 3C depicts a side sectional view of the RF MEMS system with the actuatable member in the down position.
Figure 3A:
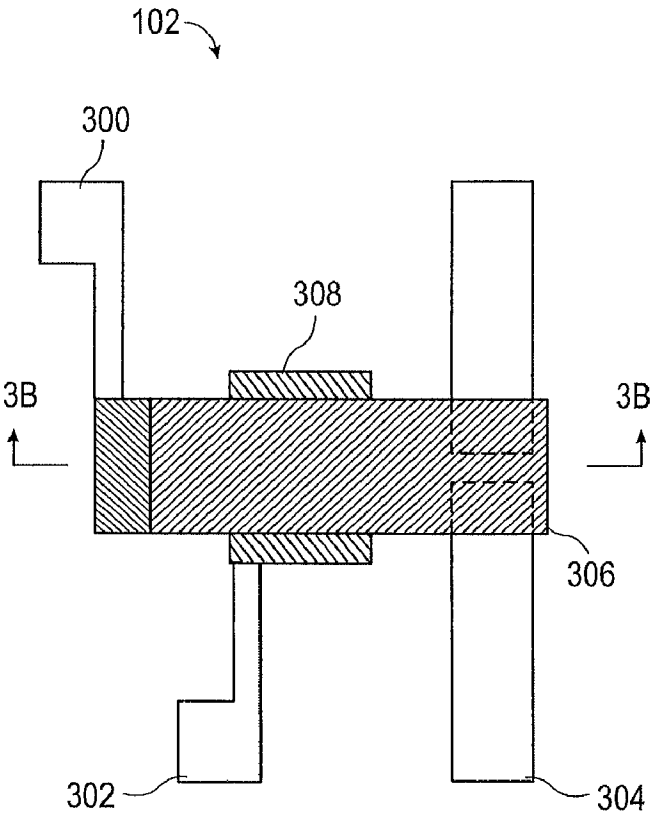
FIG. 3A depicts a top view of another embodiment of an RF MEMS system fabricated in accordance with the low temperature deposition process of the present invention.

FIG. 3A depicts a top view of another embodiment of a switch 102 fabricated using the low temperature deposition process of the present invention. In this embodiment the switch 102 is a resistive switch and includes bias pads 300, 302, a transmission line 304, which in this embodiment is a microstrip line, and a ground plane 310 located on the opposite side of substrate 114. FIG. 3B depicts a side sectional view of the switch 102 taken along line 3B-3B of FIG. 3A. In this embodiment, the bias pad 300 is not at the same height as the bias pad 302 and transmission line 304. Furthermore, an actuatable member 306 is electrically coupled to only bias pad 300, and extends over the bias pad 302 as well as the transmission line 304. In this embodiment, each of the bias pads 300 and 302 and the transmission line 304 are electrically isolated while the actuatable member 306 remains in the up or open position as depicted in FIG. 3B.

The switch potential of the actuatable member 306 is the difference in electrical potential between the two bias pads 300 and 302, which is sufficient to move the actuatable member 306 into electrical contact with the transmission line 304. Therefore, the switch 102 switches when the switch potential is sufficient to move the actuatable member 306 into proximity with the bias pad 302 and transmission line 304, such that the actuatable member 306 is in direct electrical contact with the transmission line 304. Bias pad 302 capacitively couples with actuatable member 306 through insulator layer 308, as depicted when the switch 102 is in the down or closed position in FIG. 3C. In other embodiments, bias pad 302 can be formed at a lower height than the transmission line 304, such that the bias pad 302 never physically contacts the actuatable member 306.

Because the insulator layer 308 is only deposited over the bias pad 302 and not the transmission line 304, the bias pad 300 and the transmission line 304 are brought to the same potential and DC can flow between these two members. Although in this embodiment, the actuatable member 306 is physically coupled with the bias pad 302, the two are only capacitively coupled and no direct current can flow between them. It is important to note that these embodiments are only a few examples of the switch 102 and are not exhaustive. One of ordinary skill in the art will readily recognize that numerous embodiments of the switch 102 may be implemented with the systems and methods described herein.

Figure 4:
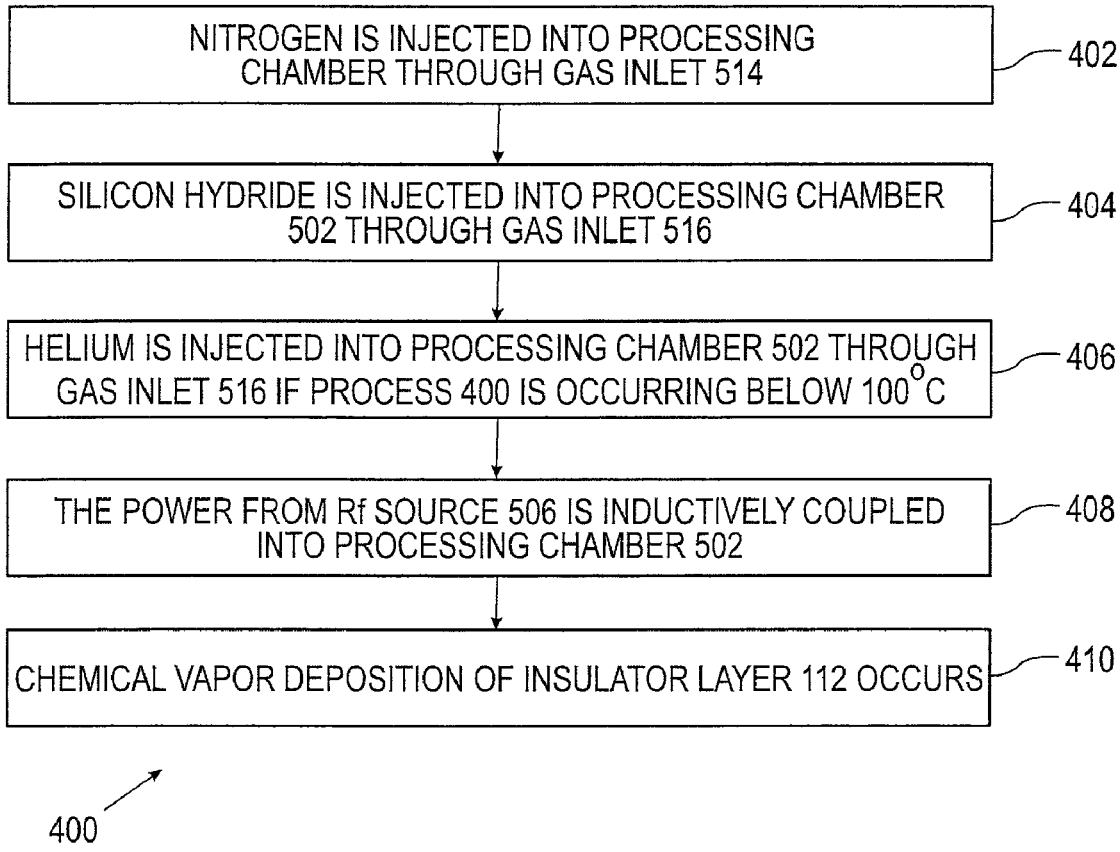
FIG. 4 depicts a flow chart of one embodiment of a low temperature deposition process of the present invention used to fabricate RF MEMS systems.

FIG. 4 depicts one preferred embodiment of the low temperature deposition process 400 of the present invention, which is preferably used to fabricate the switch 102 described above. In this example embodiment, the deposition process 400 is a low-temperature, high-density inductively coupled plasma enhanced chemical vapor deposition process (HDICP CVD). This process can deposit the insulator layer 112 at a temperature below the maximum operating temperature of the substrate 114. To facilitate discussion of the systems and methods herein, low temperature deposition process 400 will be described in the context of an HDICP CVD process, however, any deposition process that occurs at a temperature below the maximum operating temperature of the substrate can be used.

In one embodiment, the substrate 114 is a laminated PCB substrate. If the PCB substrate 114 is exposed to temperatures above its maximum operating temperature, the PCB substrate 114 will begin to degrade and deform. The physical integrity of the various layers of the PCB substrate 114 will breakdown and the PCB substrate 114 will no longer operate as intended, if at all. For instance, metal planes and metal lines in the PCB substrate 114 can each experience hillocking, i.e., defects within the metals that are manifested at high temperatures.

The maximum operating temperature of the PCB substrate 114 is typically about 175° C., depending on the time of exposure and the particular PCB substrate 114 used. Typical plasma enhanced CVD (PECVD) operates in the range of about 250-400° C., well above the maximum operating temperature of the PCB substrate 114. These temperatures prohibit deposition of the insulator layer 112 directly on the PCB substrate 114 due to the damage that would result to the PCB substrate 114. Conversely, the low temperature deposition process 400 of the present invention can operate at a wide range of temperatures, such as temperatures on the order of about 175° C. and below including temperatures below about 100° C. In one embodiment, the deposition process 400 operates in a range of about 90-170° C. In addition, the deposition process 400 does not sacrifice deposition rate or layer quality in order to achieve deposition at these low temperatures.

The insulator layer 112 can be any one of a variety of insulator layers, such as a dielectric layer. In a preferred embodiment, the insulator layer 112 is a high-K dielectric layer such as silicon nitride ($SiN_X$). In another embodiment, the insulator layer 112 is Nitride Oxide. One of skill in the art will readily recognize that other types of insulator layers can be used with the low temperature deposition process 400 of the present invention.

Figure 5:
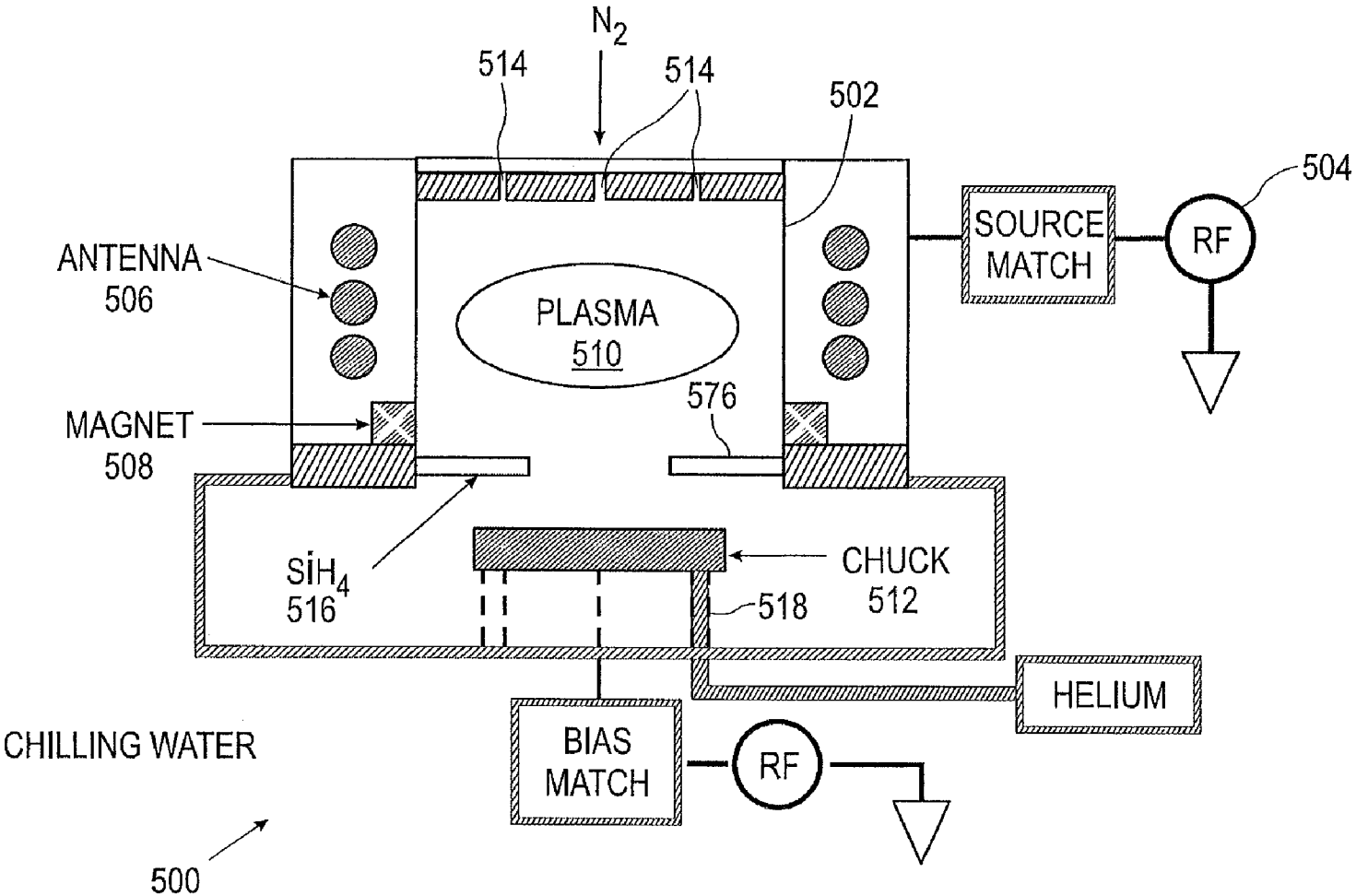
FIG. 5 depicts a plan view of one embodiment of a deposition tool that can be used to deposit an insulator layer on a substrate using the low temperature deposition process of the present invention.

FIG. 5 depicts one embodiment of a deposition tool 500 that can be used to deposit the insulator layer 112 on the substrate 114 using the low temperature deposition process 400. The deposition tool 500 is used to create a high-density plasma 510, which allows deposition at the low temperatures described above. In one embodiment, the deposition tool 500 is the Bethel Material Research (BMR) HiDep2000, although any PECVD tool configured to implement the HDICP CVD process can be used. The deposition tool 500 contains the high-density plasma 510 within a tubular processing chamber 502. An RF power source 504 is coupled with an antenna array 506, which is distributed around the circumference of the processing chamber 502. The antenna 506 is used to inductively couple the RF power from the RF source 504 into the processing chamber 502.

In one embodiment, the RF power source is a 13.56 Mhz RF power source that inductively couples the RF power into the processing chamber 502. The amount of power coupled into the processing chamber or reactor 502 can vary according to the needs of the application. Inductively coupled power in the range of about 400-900 W can be used for different applications, but this range is by no means intended to limit the range of acceptable embodiments. Magnets 508 are uniformly distributed along the base of the processing chamber 502 and facilitate the sustainment of a high dissociation level within the high-density plasma 510. In one embodiment, the magnets 508 are solenoidal magnets that are Faraday shielded, for instance, by wrapping the magnets 508 in Faraday shield copper tape.

During processing, the substrate 114 sits atop a chuck 512 and is exposed to the high-density plasma 510 in the processing chamber 502. The processing chamber 502 utilizes two separate sets of gas inlets 514 and 516. In the embodiment where the insulator layer 112 is silicon nitride, one set of gas inlets 514 is configured to inject nitrogen ($N_2$) gas into the processing chamber 502. The nitrogen gas can be used in place of ammonia ($NH_3$) in order to reduce the hydrogen (H) content in the insulator layer 112. Migration of H atoms can cause a long-term change in the dielectric properties of the insulator layer 112. The other set of gas inlets 516 are radially distributed above the chuck 512 and can be configured to inject silicon hydride ($SiH_4$) into the processing chamber 502. At temperatures below 100° C., helium (He) can be introduced into the processing chamber 502 through gas inlet 518 in order to maintain a uniform temperature distribution throughout the substrate 114.

Referring back to FIG. 4, the method of depositing the insulator layer 112 on the substrate 114 using the low temperature process 400 is described. First, at step 402, nitrogen gas is injected into the processing chamber through one set of gas inlets 514. At step 404, the silicon hydride is injected into the processing chamber 502 through the other set of gas inlets 516. At step 406, the helium is injected into the processing chamber 502 through another gas inlet 518 if the process 400 is occurring at a temperature below 100° C. At step 408, the power from the RF source 506 is inductively coupled into the processing chamber 502, increasing the energy of the plasma to create the high energy and high density plasma 510. Once the high-density plasma 510 is created, the insulator layer 112 begins to deposit on the substrate 114. At step 410, chemical vapor deposition of the insulator layer 112 occurs.

While typical PECVD processes generate plasma densities on the order of 109 ions/cm$^3$, the high-density plasma 510 created by the deposition process 400 of the present invention can have a density several magnitudes greater than these PECVD processes, e.g., a plasma density in the range of about $10^{11}$-$10^{12}$ ions/centimeter$^3$ (cm$^3$). It is this higher density which allows deposition to occur at low temperatures. The high-density plasma 510 also has a highly uniform plasma profile which allows the deposition of thin insulator layers 112 with smoother surfaces than typical PECVD processing. The smooth surface of the insulator layer 112 allows more intimate contact with the underlying surface of the substrate 114, which in this embodiment is the signal line 105. The more uniform contact in turn provides a higher down state capacitance for the switch 102, which allows for improved switching performance. In one preferred embodiment, a smooth layer 112 surface was achieved at 90° C. and 500 W RF power. In one embodiment, the surface of the PCB substrate 114 is smoothed to further increase the amount of contact with the insulator layer 112. Preferably, this is done by a chemical mechanical polishing (CMP) technique, which is a standard process technique adapted to smooth out rough layers or surfaces.

In addition, the deposition process 400 of the present invention does not sacrifice layer quality or deposition rate in order to achieve low temperature deposition. The insulator layer 112 can be deposited as a dielectric layer with a thickness on the order of about 250 Å and have a dielectric breakdown of approximately 9 MV/cm (Megavolts/centimeter), which is a level adequate for most RF applications that use actuation potentials of approximately 20-50 V. This higher dielectric breakdown performance is due in large part to the lower pinhole densities that can be achieved with the low temperature deposition process 400 of the present invention.

Figure 6A:
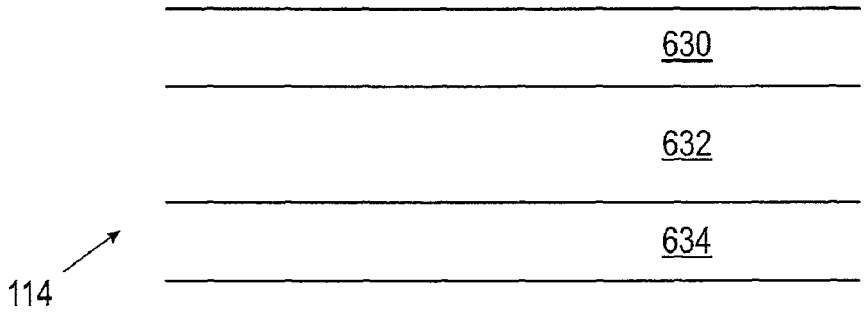
FIG. 6A depicts an elevation view of a typical PCB substrate prior to processing.
Figure 6B:
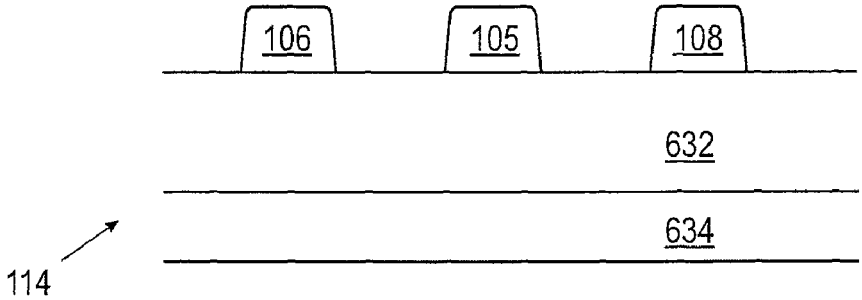
FIG. 6B depicts an elevation view of a PCB substrate after the transmission line has been etched into its top metal layer.

FIGS. 6A-J depict an embodiment of a switch fabrication process 600 of the present invention used to fabricate the switch 102. FIG. 6A depicts a typical PCB substrate 114 prior to processing. A PCB substrate 114 can typically include multiple substrate planes, or layers, to allow easier routing or isolation of separate electrical potentials. In this embodiment, the PCB substrate 114 includes a top metal layer 630, a dielectric layer 632 and a bottom metal layer 634. Each of the metal layers 630 and 634 are composed of copper or aluminum or another metal or combination suitable for the individual application. FIG. 6B depicts the PCB substrate 114 after the ground planes 106 and 108 and the signal line 105 have been etched into the top metal layer 630. Each of these members 105, 106 and 108 are at substantially the same height. Etching the members 105, 106 and 108 to substantially the same height reduces the amount of signal refraction in the lines as compared to typical RF MEMS switches that use electroplating to build the members 105, 106 and 108 from the bottom up, leaving the signal line 105 at a lower height than the ground planes 106 and 108. Because only one thickness is used for the transmission line 104, the switch 102 can be fabricated at the same time as the fabrication of the PCB substrate 114.

Figure 6C:
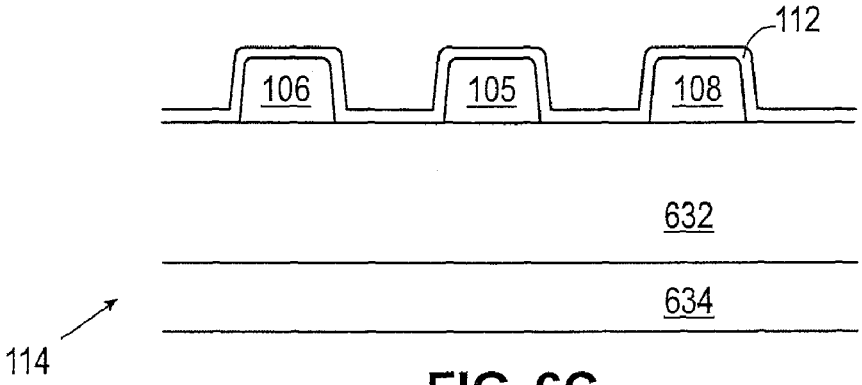
FIG. 6C depicts an elevation view of the PCB substrate after an insulator layer has been deposited using the low temperature deposition process of the present invention.
Figure 6D:
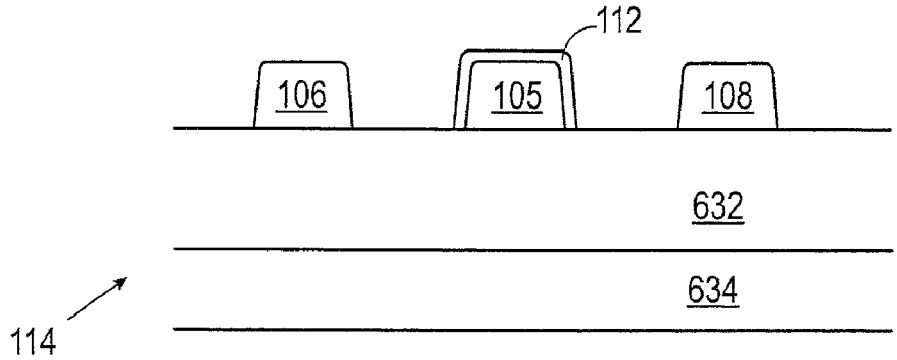
FIG. 6D depicts an elevation view of the PCB substrate after the insulator layer has been etched away.
Figure 6E:
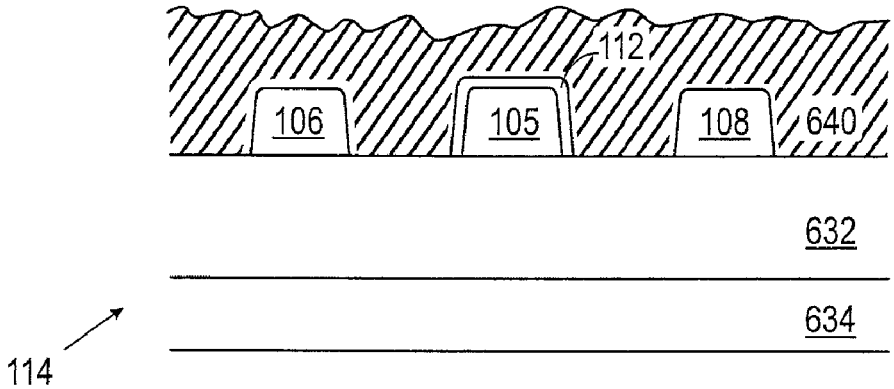
FIG. 6E depicts an elevation view of the PCB substrate after a polymer layer has been deposited over the top surface.
Figure 6F:
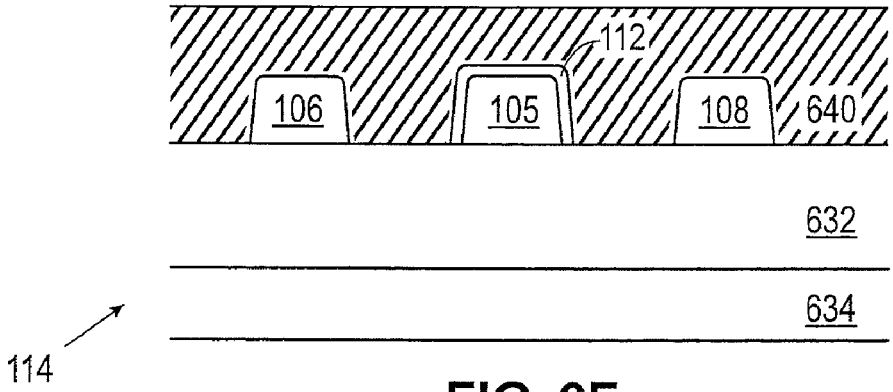
FIG. 6F depicts an elevation view of the substrate after the polymer layer has been planarized according to planarization process of the present invention.

FIG. 6C depicts the PCB substrate 114 after the insulator layer 112 has been deposited with the low temperature deposition process 400. In FIG. 6D, the insulator layer 112 has been etched away so that it substantially covers only the signal line 105. FIG. 6E depicts the PCB substrate 114 after the polymer layer 640 has been deposited over the top surface. Preferably, the polymer layer 640 is kept as uniform as possible over the transmission line 104. This is because the actuatable member 110 will be formed above the polymer layer 640 and any variations in the surface height of the polymer layer can result in a structurally unsound actuatable member 110.

Figure 7A:
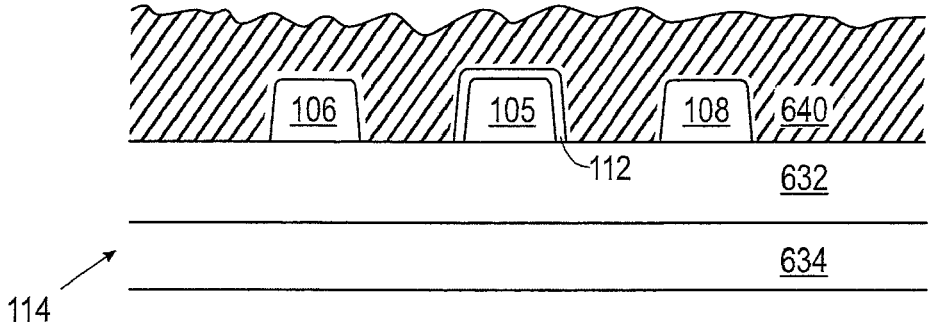
FIG. 7A depicts an elevation view of the PCB substrate after the polymer layer is deposited over the substrate.
Figure 7B:
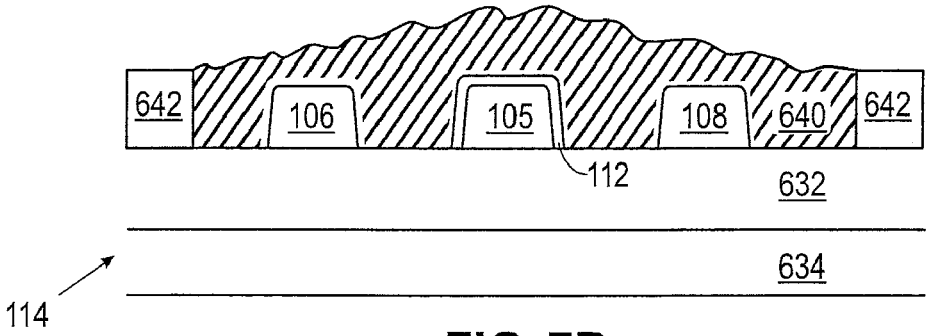
FIG. 7B depicts an elevation view showing spacers placed on the substrate for use in the planarization process of the present invention.
Figure 7C:
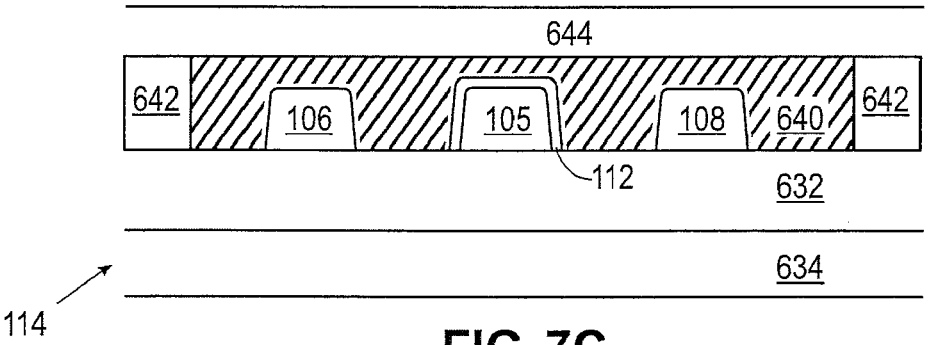
FIG. 7C depicts an elevation view of a mold used to mold and planarize the polymer layer to a desired height as determined by the size of the spacers.
Figure 7D:
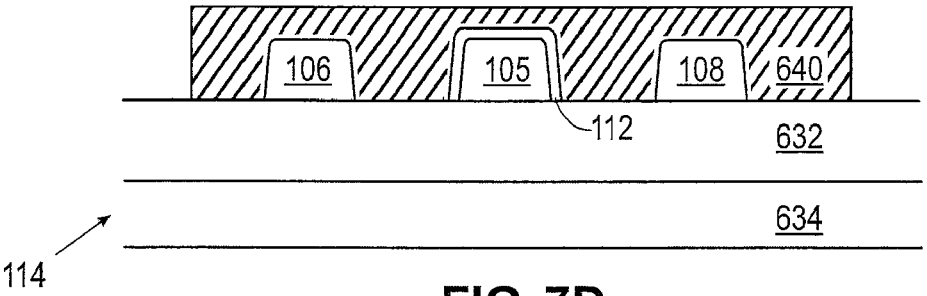
FIG. 7D depicts an elevation view of the planarized layer after the mold is removed.

To compensate for this, the polymer layer 640 can be planarized using a planarization process 700 of the present invention. Polymer layer 640 is preferably a patternable polymer. In one preferred embodiment, polymer layer 640 is a polymide patternable by etching, e.g., photoresist. However, polymer layer 640 can be patternable in any manner such as through silk-screening and the like. FIGS. 7A-D depict an embodiment of the planarization process 700 that uses compressive molding planarization (COMP). FIG. 7A depicts the PCB substrate 114 after the polymer layer 640 is deposited over substrate 114. A physical press is later used to planarize the polymer layer 640, and because the polymer layer 640 will serve as a mold for the actuatable member 110, the height of the planarized surface will define the height of the actuatable member 110. In order to ensure that the polymer layer 640 is planarized to the correct height, spacers 642 are placed on the substrate 114 as depicted in FIG. 7B. FIG. 7C depicts a mold 644 used to mold and planarize the layer 640 to the desired height as determined by the size of the spacers 642. Mold 644 can be a press, plate, roller or any other molding mechanism. The composition of the mold 644 is preferably resistant to cohesion or adhesion with the polymer layer 640 so that a substantial amount of the layer 640 does not stick to the mold 644. The composition of the mold 644 is dependent on the properties of the polymer layer 640 and will vary accordingly. In one example embodiment, the polymer layer 640 is an AZ 4600 photoresist, and the mold 644 is composed of polydimethylsiloxane (PDMS) and coated with a polymer. This configuration is but one embodiment of the invention and does not limit the invention in any way. FIG. 7D depicts the planarized layer 640 after the mold 644 is removed.

Figure 8:
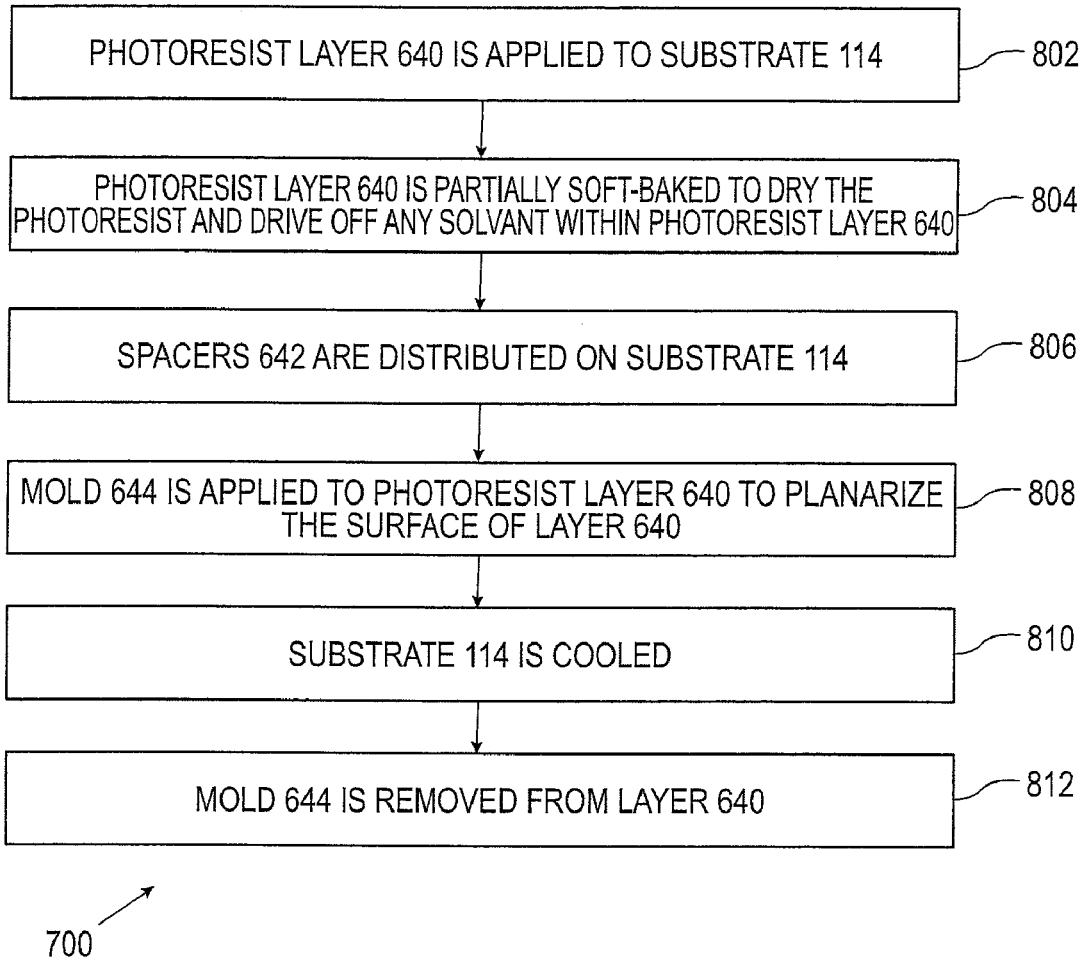
FIG. 8 depicts a flow chart of another embodiment of the planarization process of the present invention.

FIG. 8 depicts an embodiment of the planarization process 700. At step 802, the polymer layer 640 is applied to the substrate 114. In one example embodiment, this is performed by spin-coating the substrate at a low speed to provide a thickness of the polymer layer 640 greater than the height of the transmission line 104 and sufficiently high to mold the actuatable member 110 to a desired height. Next, at step 804, the polymer layer 640 is partially soft-baked to dry the polymer and drive off any solvent within the polymer layer 640. This bake step and any other process step are preferably performed at a temperature below the maximum operating temperature of the substrate 114. At step 806, the spacers 642 are distributed on the substrate 114. In another embodiment, the spacers 642 are manufactured on the mold plate itself.

At step 808, the mold 644 is applied to the polymer layer 640 to planarize the surface of the layer 640. During step 808, heat can be applied to raise the temperature of the polymer layer past it's glass transition point to facilitate planarization by softening the polymer layer 640. This step can be repeated multiple times, for instance a first time to mold the polymer layer into a specific pre-determined shape, and then a second time to planarize the surface of the polymer layer. Alternatively, instead of repeating a second time, the polymer layer can be planarized using CMP or another surface smoothing or polishing technique.

Also, in yet another embodiment, the polymer layer 640 can be patterned using photolithography and after each molding step 808. In this embodiment the polymer layer 640 is a photoresist processed according to the manufacturer's instructions to complete total curing and crosslinking of the layer 640. After this, the polymer layer 640 will have a higher glass transition point than before the cure. Thus, molding step 802-808 can be repeated to mold a new polymer layer 640 over the previously molded and patterned layer 640. This process can be repeated as desired to create high aspect structures of arbitrary complexity. At step 810, the substrate 114 is cooled and finally, at step 812, the mold 644 is removed from the layer 640, leaving the layer 640 planarized and ready for further processing.

Figure 6G:
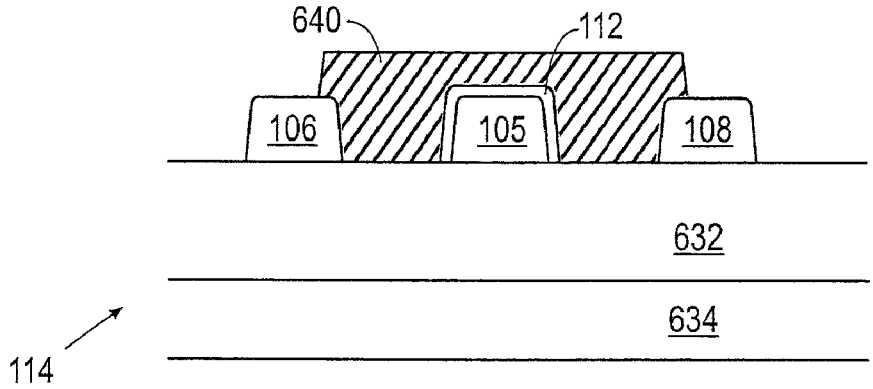
FIG. 6G depicts an elevation view of the substrate after the polymer layer is patterned to form a mold for a conductive actuatable member.
Figure 6H:
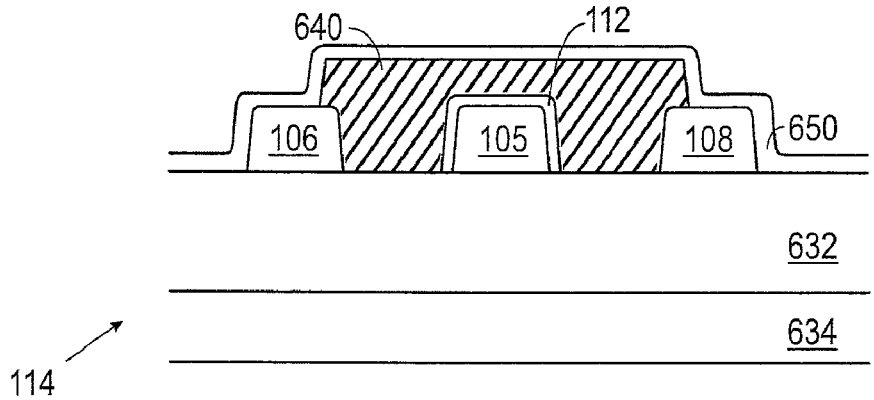
FIG. 6H depicts an elevation view of the substrate after a conductive layer is deposited over the substrate.
Figure 6I:
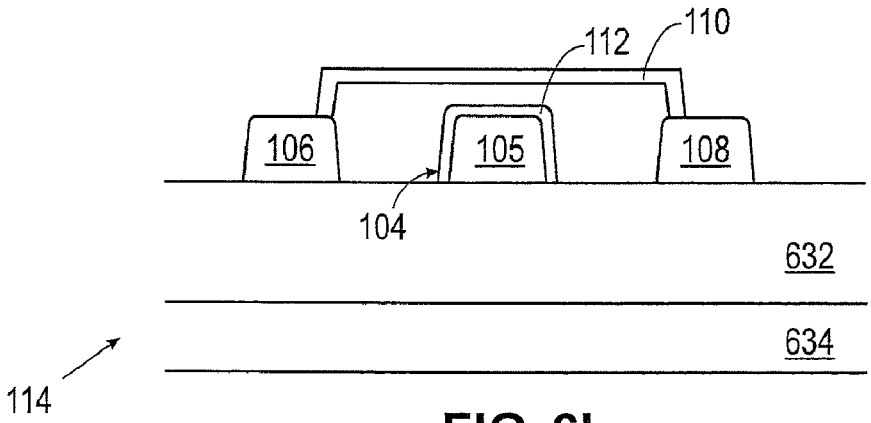
FIG. 6I depicts an elevation view of the substrate after the conductive layer is etched to define the actuatable member and the remaining polymer layer is removed to leave the actuatable member isolated above a signal line.

Referring back to FIGS. 6A-J, FIG. 6F depicts the substrate 114 after the polymer layer 640 has been planarized according to the planarization process 700 of the present invention. It should be noted that if the polymer layer 640 is deposited with a sufficient degree of uniformity, the planarization process 700 may not be needed. The polymer layer 640 is then patterned to form a mold for the actuatable member 110, as depicted in FIG. 6G. The conductive layer 650 is then deposited over the substrate 114 as depicted in FIG. 6H. The conductive layer 650 can be any conductive material that can operate with the desired degree of rigidity to allow the member 110 to move. The conductive layer 650 is then etched to define the member 110, and the remaining polymer layer 640 is then removed to leave the member 110 isolated above the signal line 105 as depicted in FIG. 6J.

Figure 9:
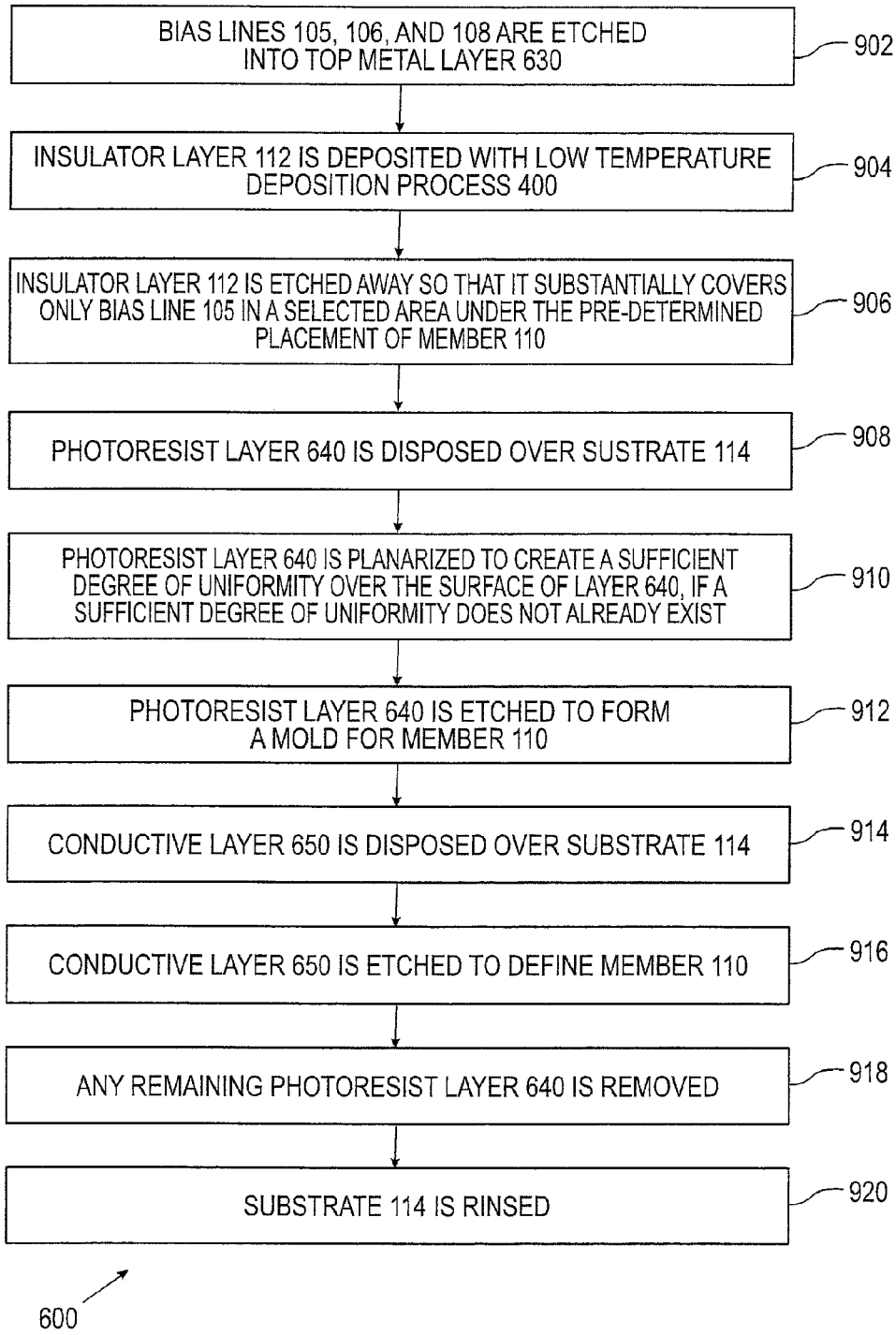
FIG. 9 depicts a flow chart of another embodiment of a switch fabrication process of the present invention.

FIG. 9 depicts an embodiment of the switch fabrication process 600 of the present invention. At step 902, the transmission line 104 is etched into the pre-existing top metal layer 630. In one embodiment, the etching process is a wet etch process. In yet another embodiment, other system components are formed concurrently with forming the transmission line 104, including electrical, optical, fluidic, structural and mechanical structures and elements. Then, at step 904, the insulator layer 112 is deposited using the low temperature deposition process 400 of the present invention. At step 906, the insulator layer 112 is etched away so that it substantially covers only the signal line 105 in a selected area under the pre-determined placement of the actuatable member 110. In a preferred embodiment, this etching process is a reactive ion etching process. Next, at step 908, the polymer layer 640 is deposited over the substrate 114. At step 910, the polymer layer 640 is planarized to create a sufficient degree of uniformity over the surface of the layer 640, if a sufficient degree of uniformity does not already exist. Preferably, the planarization process 700 is used to planarize the polymer layer 640 at step 910. The degree of uniformity that is considered sufficient is dependent on the implementation and design of the switch 102. A sufficient degree can be any degree of uniformity that allows the actuatable member 110 to function as desired by the application.

Then, at step 912, the polymer layer 640 is patterned to form a mold for the actuatable member 110. At step 914, the conductive layer 650 is deposited over the substrate 114. In one embodiment, the conductive layer 650 is deposited using a low temperature metal sputtering process. The low temperature sputtering process, preferably at a temperature below the maximum operating temperature of the substrate 114, tends to reduce the compressive stress and stress gradients that are typically found in the conductive layers 650. At step 916, the conductive layer 650 is etched to define the actuatable member 110. In one embodiment, this etch can be a selective wet etch. Next, at step 918, any remaining polymer layer 640 is removed. In one embodiment, the polymer layer 640 is removed by soaking the substrate 114 in acetone. Finally, at step 920, the substrate 114 is rinsed to eliminate liquid surface tension on the actuatable member 110 to avoid the actuatable member 110 being pulled down onto the insulator layer 112. In one embodiment, the substrate 112 is rinsed in boiling methanol.

The systems and methods described herein also provide for the monolithic integration of an RF MEMS system 100 not only with other MEMS systems or components, but with other non-MEMS components on the same substrate 114. One of skill in the art will readily recognize that there are numerous other components that can be integrated with the RF MEMS system 100. For RF systems, one such component that is desirable to implement on the same substrate 114 as the MEMS switch 102 is an antenna due to the high range of frequencies that can be implemented. In fact, a host of differing antenna configurations can be integrated with the RF MEMS system 100 such as two- and three-dimensional antennas, phased-array antennas, reconfigurable antennas and other smart antenna systems. In addition, the support circuitry for these antennas, such as a phase shifter for a phased array antenna, can also be monolithically integrated with the RF MEMS system 100.

Figure 10:
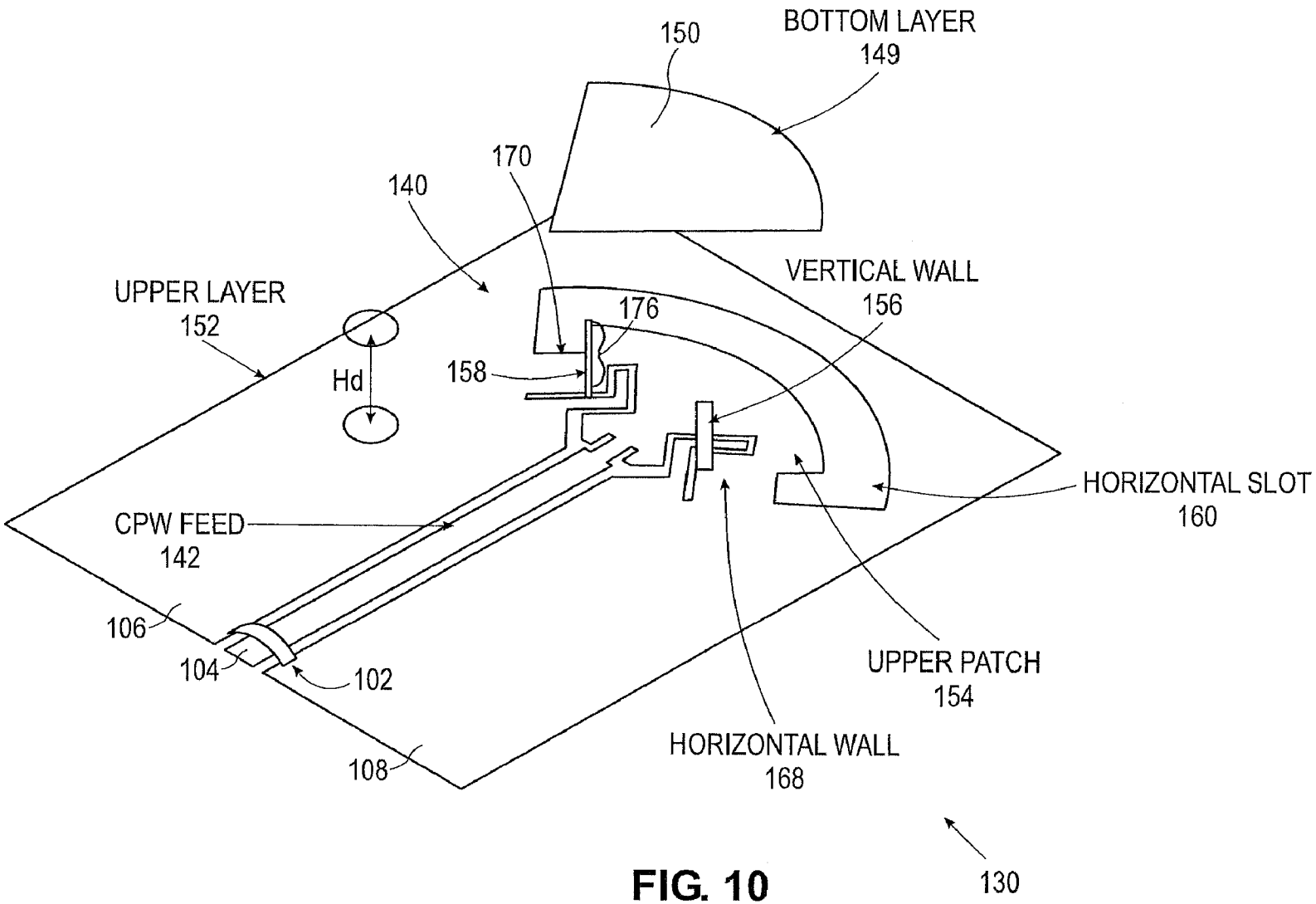
FIG. 10 depicts an isometric view of one embodiment of an integrated RF system of the present invention.

FIG. 10 depicts one embodiment of an integrated RF system 130 of the present invention. RF system 130 integrates the RF MEMS system 100 described above with a non-MEMS component 140. The system 130 has no loss at the component-to-component interconnects because all of the components 102 and 140 are integrated together on the same substrate 114, which also eliminates the need for matching circuits. In addition, all of the components of the system 130 can be fabricated concurrently. In this embodiment, non-MEMS component 140 is an electromagnetic three-dimensional (3D) antenna. The RF system 130 with a 3D antenna can be implemented in multiple environments, such as in a mobile phone and he like. The antenna 140 is fabricated directly on the substrate 114 and is coupled with the switch 102 by a coplanar waveguide (CPW) 142. The antenna 140 includes a bottom layer 149, a bottom patch 150, an upper layer 152 and vertical walls 156 and 158. For ease of illustration, the antenna 140 is shown upside down in FIG. 10, with its bottom layer 150 unattached.

Between the upper layer 152 and the bottom patch 150 is a dielectric plane 632 of the PCB substrate 114 (not shown). PCB substrate 114 can have numerous dielectric planes 632 in addition to ground planes and power supply planes located in different layers throughout the substrate 114. In this embodiment, RF system 130 may include additional planes that are not shown. The vertical walls 156 and 158 are formed in the via through-holes 196 (discussed below) of the PCB substrate 114 and couple the upper and bottom patch layers 150 and 152 together. Because the substrate 114 is used as a component of the antenna 140, the electrical characteristics of the substrate 114, particularly the loss properties, should be taken into account before choosing a particular substrate 114.

Figure 11A:
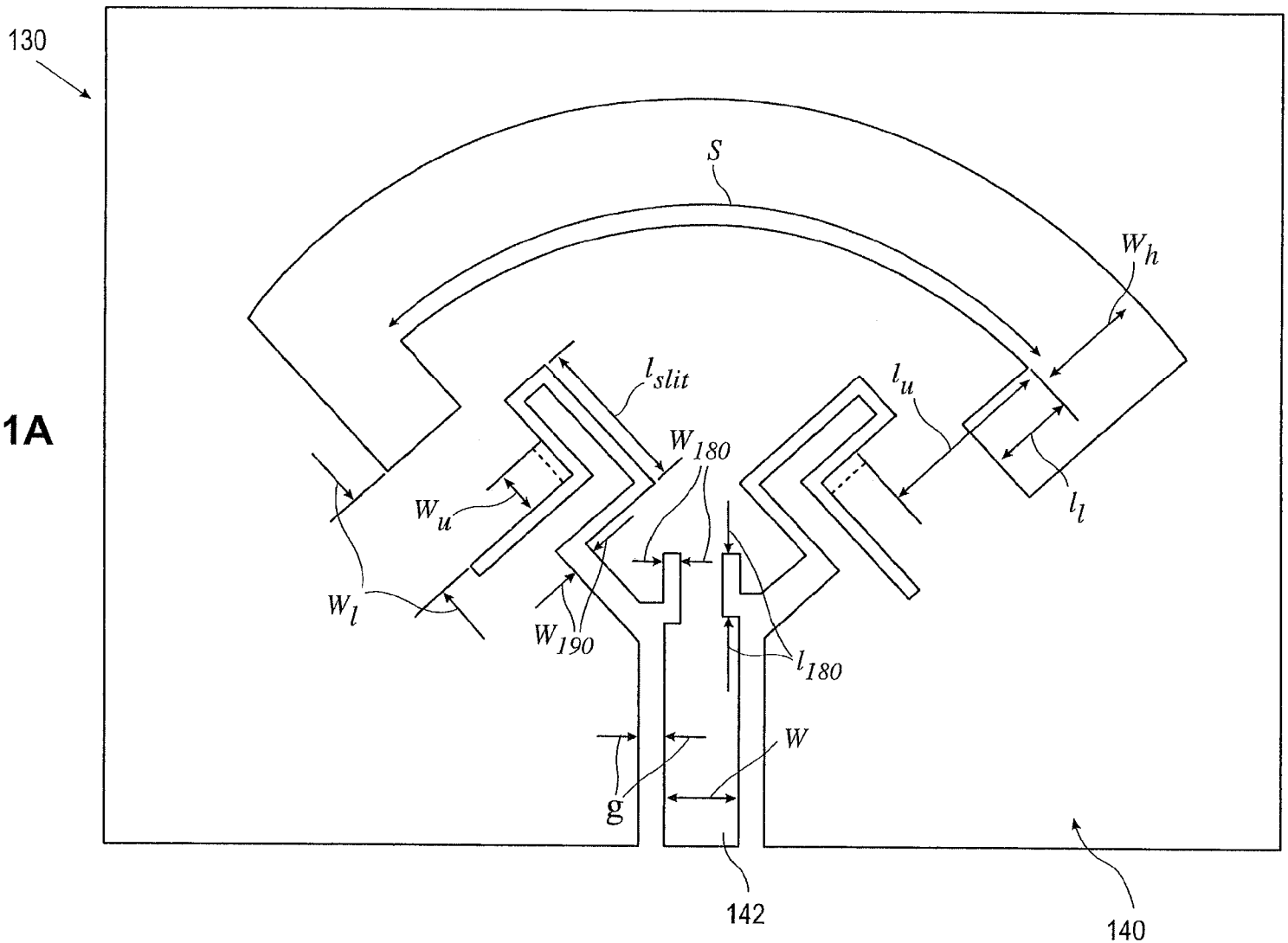
FIG. 11A depicts a top view of one embodiment of an upper layer of the RF system shown in FIG. 10.

The bottom patch 150 preferably has a semi-circular pattern and in this embodiment the bottom patch 150 has a quarter-circular pattern. The upper layer 152 includes an upper patch 154, a CPW 142, a horizontal slot 160, a horizontal wall 168 and a vertical slot 170. The vertical walls 156 and 158 are preferably of the same size and dimensions, but will vary slightly due to variances in the fabrication of the via through-holes. Each vertical wall 156 and 158 has a height 176. FIG. 11A depicts a top view of one embodiment of the upper layer 152 of the RF system 130. The length of the horizontal slot 160 is given as:

$$S_l = S + 2l_l \tag{1}$$

The length of the horizontal wall 168 is given as $w_l$. The width of the horizontal slot 160 is given as $w_h$. The length of the vertical walls 156 and 158 is given as $w_u$. The length of the vertical slot 170 is given as:

$$S_u = S + 2l_u \tag{2}$$

Due to the presence of the two slots 160 and 170, the antenna 140 can have dual frequency or dual-band capabilities. The resonant frequency for the horizontal slot 160 ($F_l$) and the vertical slot 170 ($F_u$) is determined by the lengths of each slot, $S_l$ and $S_u$, respectively. This allows the antenna 140 to be a scalable antenna, configured for multiple frequency applications. The length of each slot 160 and 170 can further be given as:

$$S_l = \lambda_l/2 \tag{3}$$

$$S_u = \lambda_u/2 \tag{4}$$

where $\lambda_l$ is the wavelength of the horizontal slot 160 and $\lambda_u$ is the wavelength of the vertical slot 170.

The wavelengths of slots 160 and 170, $\lambda_l$ and $\lambda_u$, are given as:

$$\lambda_l = \frac{2c}{F_l\left(1+\sqrt{\varepsilon_r}\right)} \tag{5}$$

$$\lambda_u = \frac{2c}{F_u\left(1+\sqrt{\varepsilon_r}\right)} \tag{6}$$

where c is the speed of light in air and $\in_r$ is the dielectric constant of the PCB substrate 114.

In one embodiment, the antenna 140 is reconfigurable. A switch 102 can be added to any one of the portions of the antenna 140 to alter the electrical properties of the antenna. For instance, the addition of a switch 102 to the vertical walls 156 and 158, the vertical slot 170, the horizontal slot 160 or the horizontal wall 168 can alter the electrical property of that portion, in turn altering the electrical properties of the antenna 140.

Figure 12A:
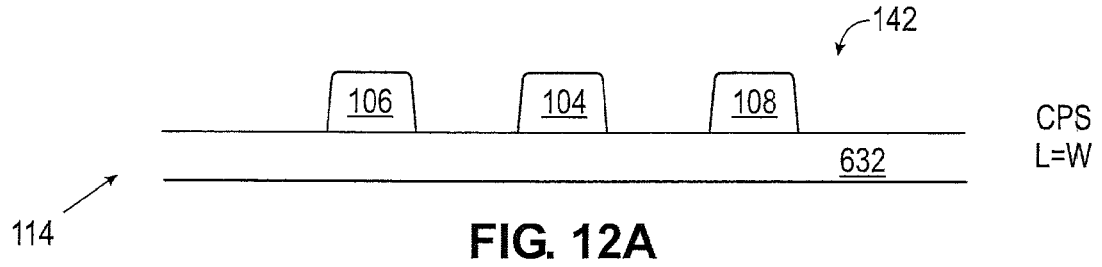
FIG. 12A depicts an elevation view of an embodiment of a co-planar waveguide (CPW) where ground planes are roughly the same width as a signal line.
Figure 12B:
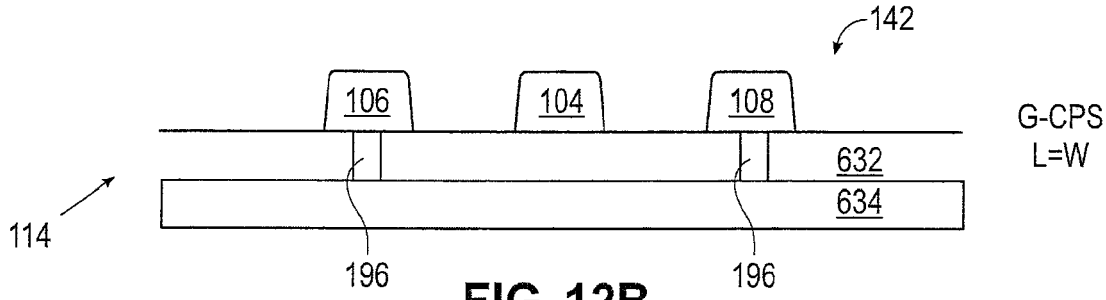
FIG. 12B depicts an elevation view of a similar embodiment to FIG. 12A with the exception of the ground planes being coupled to a bottom metal layer by vias through a dielectric layer.
Figure 12C:
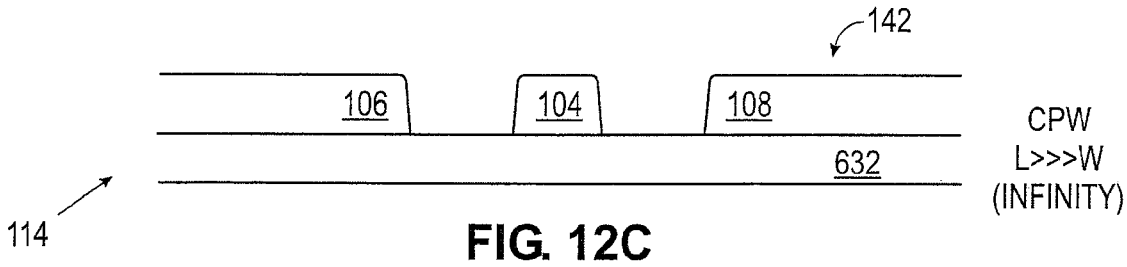
FIG. 12C depicts an elevation view of an embodiment of a CPW where ground planes are much wider than a signal line.
Figure 12D:
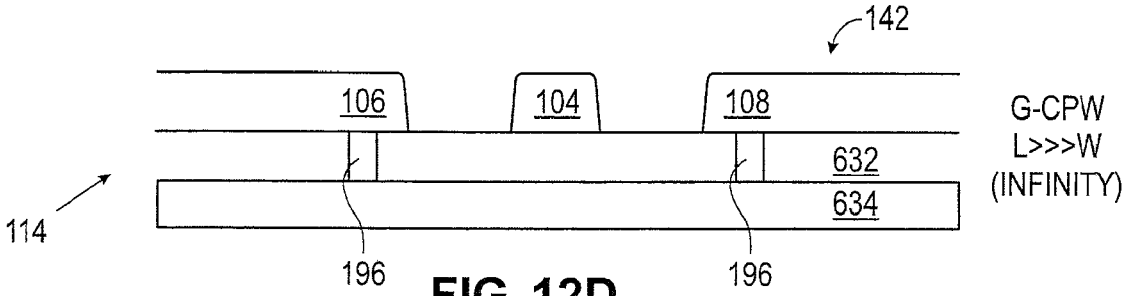
FIG. 12D depicts an elevation view of a similar embodiment to FIG. 12C with the exception of the ground planes being coupled to a bottom metal layer by vias through a dielectric layer.

The CPW 142 preferably includes two ground planes 106 and 108 and a signal line 105. Various embodiments of the CPW 142 can be implemented. FIGS. 12A-D depict four embodiments of the CPW 142. FIG. 12A depicts an embodiment of the CPW 142 where the ground planes 106 and 108 are roughly the same width as the signal line 105. FIG. 12B depicts a similar embodiment to FIG. 12A, except here the ground planes 106 and 108 are coupled to the bottom metal layer 634 by via through holes 196 through the dielectric layer 632. FIG. 12C depicts an embodiment of the CPW 142 where the ground planes 106 and 108 are much wider than the signal line 105 and FIG. 12D depicts a similar embodiment to FIG. 12C, except here the ground planes 106 and 108 are coupled to the bottom metal layer 634 by vias 196 through the dielectric layer 632. The use of vias 196 to provide electrical connections to the CPW 142 through the substrate 114 allows placement of additional circuitry on the side of the substrate 114 opposite to the CPW 142. For instance, the CPW 142 can be placed on one side of the substrate 114 and electrically connected, by vias 196, to additional circuitry on the opposite side of the substrate 114, such as control circuitry for the CPW 142 and the like.

There are also other embodiments of CPW 142 not shown, such as a conductor backed CPW (CBCPW). A CBCPW has an additional ground plane on the opposite side of the substrate 114 in addition to the bottom metal layer 634, both of which are located on a PCB substrate plane separate from the plane where the signal line 105 is located. In another embodiment, a microstrip line is used instead of CPW 142.

The antenna 140 is fed by the CPW 142 which in turn is coupled with the RF device (not shown) that generates the RF signal to be transmitted by the antenna 140 or processes the RF signal received by antenna 140, or both. Typically the RF device will be an amplifier or transceiver. The switch 102 can reconfigure the resonant frequency of the CPW 142 and in that manner control the signals transmitted or received by the antenna 140. In addition, multiple antennas 140 can be coupled together by one or more switches 102 according to the needs of the individual application.

Figure 11B:
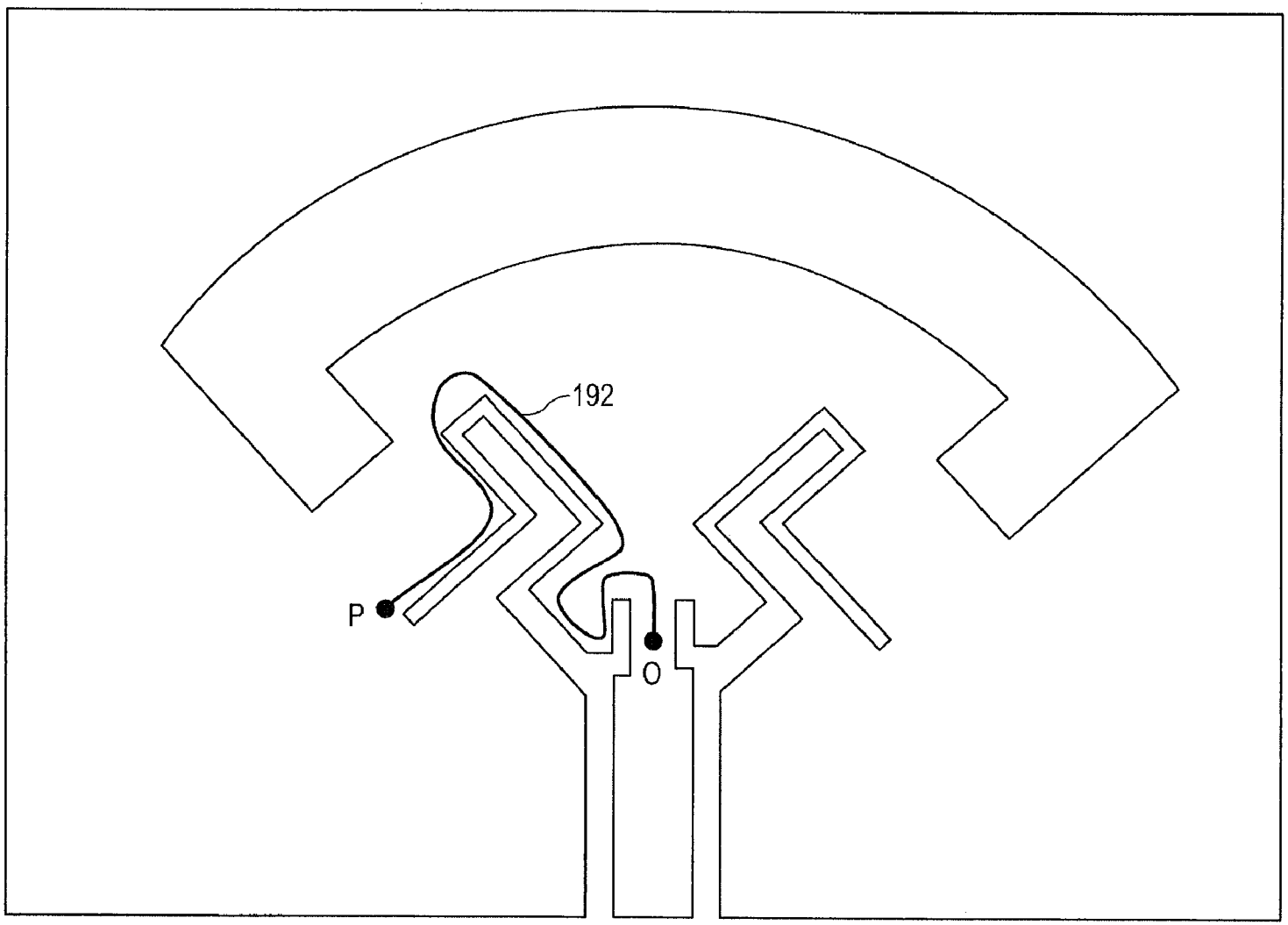
FIG. 11B depicts a top view of one embodiment of an upper layer of the RF system shown in FIG. 10.

In a preferred embodiment, the CPW 142 has about a 50-ohm characteristic impedance, determined by the width (w), gap spacing (g) and thickness ($h_d$) of the substrate 114. The operation of the CPW 142 is readily apparent to one of ordinary skill in the art. To match the impedance of the CPW 142 with the input impedance of the antenna 140, the dimensions of $w_{180}$, $l_{180}$ and $w_{190}$ (See FIG. 11A) are chosen accordingly. These dimensions along with the length $l_{slit}$ of the slit are chosen such that the associated equivalent inductance and capacitance provide about a 50-ohm characteristic impedance. Again, varying the impedance and capacitance of the CPW 142 is readily apparent to one of ordinary skill in the art. FIG. 11B again depicts a top view of one embodiment of upper layer 152 of the RF system 130. The length $l_{slit}$ is chosen so that the distance from point O to point P, along line 192 is one quarter of any wavelength between $\lambda_l$ and $\lambda_u$.

Figure 13A:
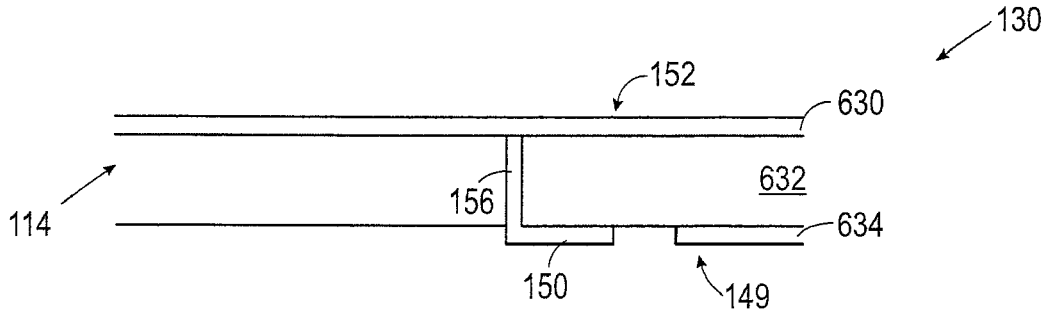
FIG. 13A depicts an elevation view of a PCB substrate after a bottom patch and vertical walls are formed using standard PCB processing.
Figure 13B:
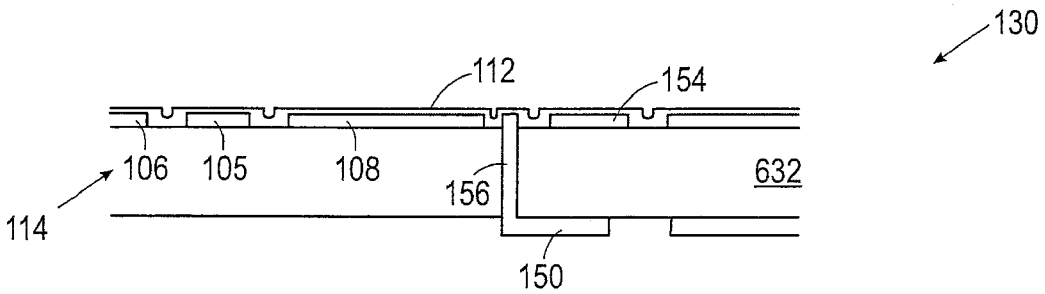
FIG. 13B depicts an elevation view of the PCB substrate after an upper patch and a transmission line has been etched, and the insulator layer has been deposited over the PCB substrate using the low temperature deposition process of the present invention.
Figure 13C:
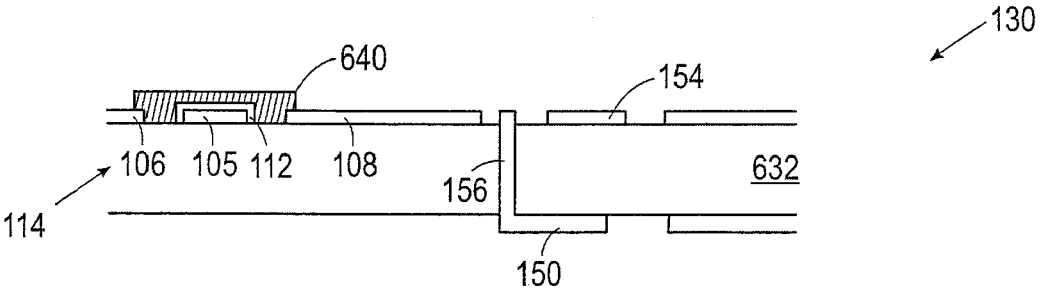
FIG. 13C depicts an elevation view of the substrate after a polymer layer has been planarized according to the planarization process of the present invention.
Figure 13D:
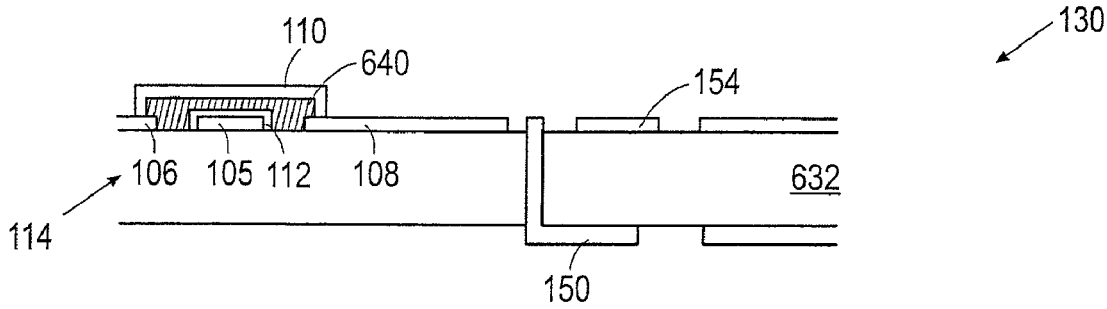
FIG. 13D depicts an elevation view of the PCB substrate after the deposition and etching of an actuatable member.
Figure 13E:
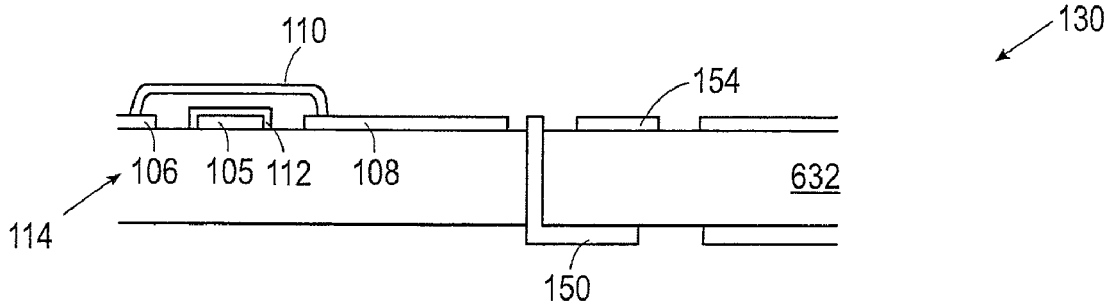
FIG. 13E depicts an elevation view of the final structure of an integrated RF system of the present invention.

FIGS. 13A-E depict one embodiment of the integrated fabrication process 1400, which is used to fabricate an integrated RF system 130. This process 1400 allows for numerous components 100, 102, 140 and 142 to be fabricated concurrently in one fabrication process. FIG. 13A depicts the PCB substrate 114 after the bottom patch 150 and vertical walls 156 and 158 are formed using standard PCB processing. FIG. 13B depicts the PCB substrate 114 after the upper patch 154 and the signal line 105 as well as the ground planes 106 and 108 have been etched, and the insulator layer 112 has been deposited over the PCB substrate 114 using a low temperature deposition process of the present invention, such as low temperature deposition process 400. FIGS. 13C-E depicts the remaining portions of the fabrication as described above. FIG. 13C depicts the substrate 114 after the polymer layer 640 has been planarized, if needed, according to the planarization process 700 of the present invention. FIG. 13D depicts the PCB substrate 114 after the deposition and etching of the actuatable member 110 and FIG. 13E depicts the final structure of the integrated RF system 130.

Figure 14:
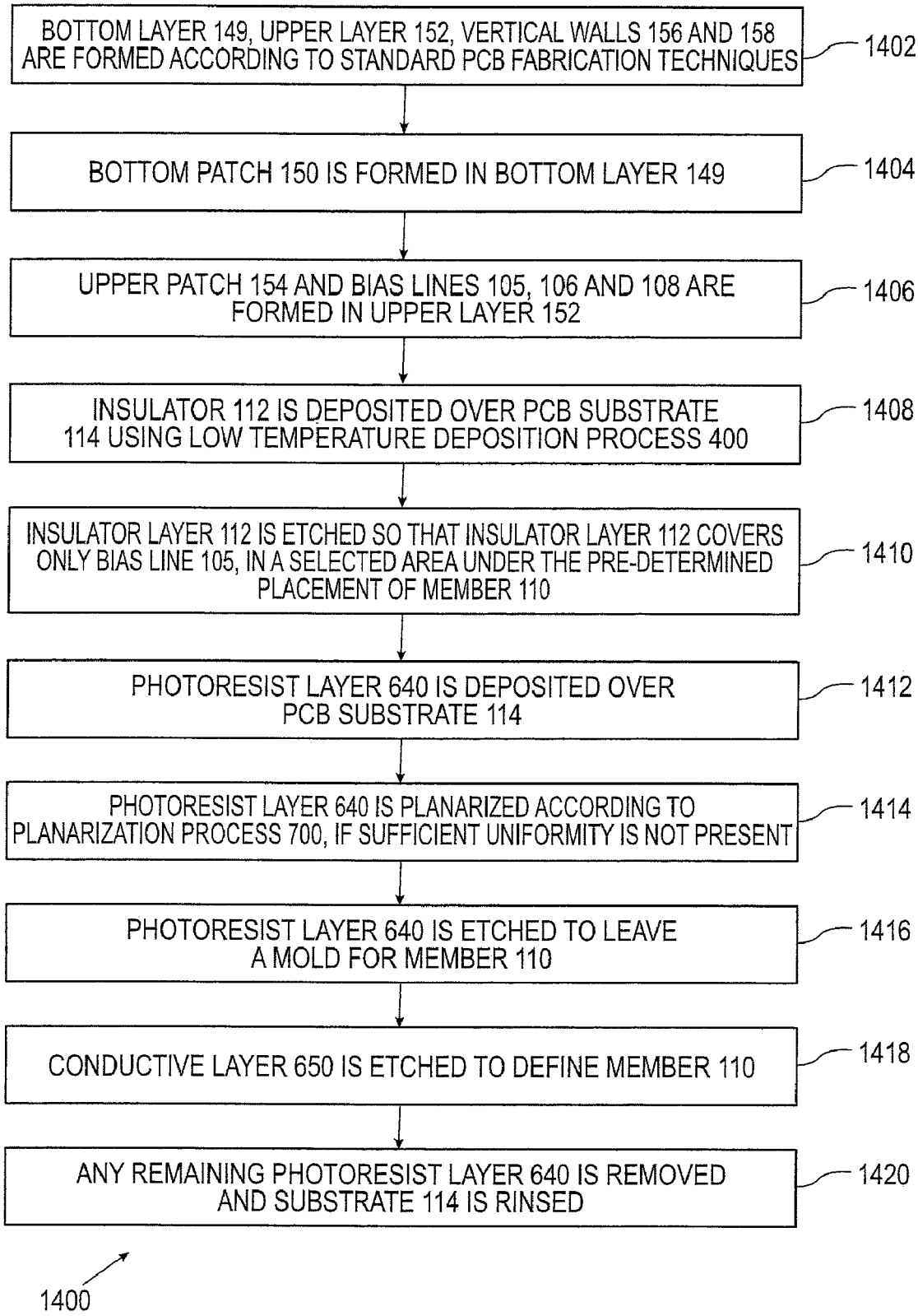
FIG. 14 depicts a flow chart of one embodiment of an integrated fabrication process of the present invention.

FIG. 14 depicts one embodiment of integrated fabrication process 1400. At step 1402, the bottom layer 149, the upper layer 152 and vertical walls 156 and 158 are formed according to standard PCB fabrication techniques. At step 1404, the bottom patch 150 is formed in the bottom layer 149. Then, at step 1406, the upper patch 154, the signal line 105 and the ground planes 106 and 108 are formed in the upper layer 152. Both steps 1404 and 1406 use standard PCB etch processes, preferably wet etch of a pre-existing conductive layer. However, the steps 1404 and 1406 can also be implemented by electroplating techniques. Next, at step 1408 the insulator layer 112 is deposited over the PCB substrate 114 using the low temperature deposition process 400 of the present invention. Then, at step 1410, the insulator layer 112 is etched so that the insulator layer 112 covers only the signal line 105, in a selected area under the pre-determined placement of the actuatable member 110. At step 1412, the polymer layer 640 is deposited over the PCB substrate 114 and at step 1414, the polymer layer 640 is planarized according to planarization process 700 of the present invention, if sufficient uniformity is not already present. At step 1416, the polymer layer 640 is patterned to leave a mold for the actuatable member 110. At step 1418, the conductive layer 650 is etched to define the actuatable member 110. Then, at step 1420, any remaining polymer layer 640 is removed and the substrate 114 is rinsed.

In the foregoing specification, the invention has been described with reference to specific embodiments thereof. It will, however, be evident that various modifications and changes may be made thereto without departing from the broader spirit and scope of the invention. For example, the reader is to understand that the specific ordering and combination of process actions shown in the process flow diagrams described herein is merely illustrative, unless otherwise stated, and the invention can be performed using different or additional process actions, or a different combination or ordering of process actions. As another example, each feature of one embodiment can be mixed and matched with other features shown in other embodiments. Features and processes known to those of ordinary skill may similarly be incorporated as desired. Additionally and obviously, features may be added or subtracted as desired. Accordingly, the invention is not to be restricted except in light of the attached claims and their equivalents.

What is claimed is:

1. An electrical apparatus, comprising:

a printed circuit board (PCB) substrate having a maximum operating temperature less than 200 degrees Celsius and an integral antenna formed on the PCB substrate without an intermediate coupling material or member; and a micro-electro-mechanical (MEM) device coupled directly to the PCB substrate without an intermediate coupling material or member, the MEM device being electrically coupled with the antenna.

2. The electrical apparatus of claim 1, wherein the MEM device is a switch.

3. The electrical apparatus of claim 2, wherein the MEM device comprises:

a first member comprising a conductive material and formed in a metal laminated layer of the PCB substrate;

a second member formed in the metal laminated layer of the PCB substrate; and an actuatable member comprising a conductive material, a first end and a second end, wherein the first end is coupled directly to the first conductive member without an intermediate coupling material or member and the second end is suspended above the second member, wherein the actuatable member is moveable in relation to the second member and the second member is configured to induce movement of the actuatable member.

4. The electrical apparatus of claim 3, wherein the second member is configured to induce movement of the actuatable member into contact with the second member.

5. The electrical apparatus of claim 4, wherein the second member comprises an insulator layer configured to prevent substantial flow of direct current between the second member and the actuatable member.

6. The electrical apparatus of claim 2, wherein the MEM device comprises:

a first member comprising a conductive material and formed in a metal laminated layer of the PCB substrate;

a second member formed in the metal laminated layer of the PCB substrate; and an actuatable member comprising a conductive material, a first end and a second end, wherein the first end is coupled directly to the first conductive member without an intermediate coupling material or member and the second end is suspended above the second member, wherein the actuatable member is moveable in relation to the second member.

7. The electrical apparatus of claim 1, wherein the MEM device comprises a dielectric layer coupled directly to the PCB substrate without an intermediate coupling material or member.

8. The electrical apparatus of claim 7, wherein the MEM device comprises a conductive member coupled directly to the PCB substrate without an intermediate coupling material or member.

9. The electrical apparatus of claim 1, wherein the MEM device is configured for use with a radio frequency (RF) signal.

10. The electrical apparatus of claim 1, further comprising an antenna formed on the PCB substrate, the antenna being electrically coupled with the MEM device.

11. The electrical apparatus of claim 1, wherein the MEM device is a switch.

12. The electrical apparatus of claim 1, wherein the MEM device is a filter.

13. The electrical apparatus of claim 1, wherein the MEM device is a variable impedance device.

14. The electrical apparatus of claim 1, wherein the MEM device is a radio frequency (RF) matching circuit.

* * * * *